US010618278B2

(12) United States Patent
Takagi

(10) Patent No.: US 10,618,278 B2
(45) Date of Patent: Apr. 14, 2020

(54) LIQUID EJECTING APPARATUS

(71) Applicant: SEIKO EPSON CORPORATION, Tokyo (JP)

(72) Inventor: Tetsuo Takagi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/356,017

(22) Filed: Mar. 18, 2019

(65) Prior Publication Data

US 2019/0291417 A1 Sep. 26, 2019

(30) Foreign Application Priority Data

Mar. 20, 2018 (JP) ..... 2018-052192
Jul. 26, 2018 (JP) ..... 2018-140428

(51) Int. Cl.
*B41J 2/045* (2006.01)
*B41J 2/14* (2006.01)

(52) U.S. Cl.
CPC ..... *B41J 2/04541* (2013.01); *B41J 2/0455* (2013.01); *B41J 2/04548* (2013.01); *B41J 2/04555* (2013.01); *B41J 2/04581* (2013.01); *B41J 2/04588* (2013.01); *B41J 2/04593* (2013.01); *B41J 2/04596* (2013.01); *B41J 2/14233* (2013.01); *B41J 2002/14241* (2013.01); *B41J 2002/14362* (2013.01); *B41J 2002/14419* (2013.01)

(58) Field of Classification Search
CPC .. B41J 2/04541; B41J 2/04548; B41J 2/0455; B41J 2/04555; B41J 2/04581; B41J 2/04588; B41J 2/04593
See application file for complete search history.

(56) References Cited

U.S. PATENT DOCUMENTS

2011/0121096 A1* 5/2011 Nihei ..... H01L 41/0973 239/102.2
2013/0229678 A1 9/2013 Ishikawa et al.
2014/0267499 A1* 9/2014 Kato ..... B41J 2/1632 347/50
2017/0057221 A1 3/2017 Nozawa
2019/0232656 A1* 8/2019 Matsumoto ..... B41J 2/04541

FOREIGN PATENT DOCUMENTS

JP 2013-180480 A 9/2013
JP 2017-043007 A 3/2017

* cited by examiner

*Primary Examiner* — Lamson D Nguyen
(74) *Attorney, Agent, or Firm* — Global IP Counselors, LLP

(57) ABSTRACT

A liquid ejecting apparatus includes a drive circuit that outputs a drive signal, a criterion voltage circuit that outputs a criterion voltage signal from a criterion voltage-signal output terminal, a piezoelectric element that includes a first electrode to which the drive signal is supplied and a second electrode to which the criterion voltage signal is supplied, a cavity, and a vibration plate which is provided between the cavity and the piezoelectric element. The criterion voltage circuit includes a voltage generation unit that generates the criterion voltage signal, and a voltage detection unit that detects a voltage value of the criterion voltage signal. In a case where the voltage value of the criterion voltage signal is greater than a first threshold, the voltage detection unit stops an operation of the voltage generation unit and electrically connects the criterion voltage-signal output terminal and a ground terminal to each other.

8 Claims, 21 Drawing Sheets

| | | LARGE DOT | MEDIUM DOT | SMALL DOT | FINE VIBRATION |
|---|---|---|---|---|---|
| [SIH, SIL] | | [1, 1] | [1, 0] | [0, 1] | [0, 0] |
| S | T1 | H | H | L | L |
| | T2 | H | L | H | L |
| | T3 | L | L | L | H |

LIQUID EJECTING APPARATUS

The entire disclosure of Japanese Patent Application No. 2018-052192, filed Mar. 20, 2018 and 2018-140428, filed Jul. 26, 2018 are expressly incorporated by reference herein.

BACKGROUND

1. Technical Field

The present invention relates to a liquid ejecting apparatus.

2. Related Art

It is known that, for example, a piezoelectric element is used in an ink jet printer (liquid ejecting apparatus) that performs printing of an image or a document by ejecting a liquid such as an ink. The piezoelectric element is provided to correspond to a plurality of nozzles of ejecting an ink and a cavity that stores the ink to be ejected from the nozzle in a print head. If the piezoelectric element performs displacement in accordance with a drive signal, a vibration plate provided between the piezoelectric element and the cavity bends, and thus the volume of the cavity changes. Accordingly, a predetermined amount of ink is ejected from the nozzles at a predetermined timing, and thereby a dot is formed on a medium.

JP-A-2017-43007 discloses a liquid ejecting apparatus as follows. The liquid ejecting apparatus ejects an ink by controlling displacement of a piezoelectric element that performs displacement based on a potential difference between an upper electrode and a lower electrode, in a manner that a drive signal generated based on print data is supplied to the upper electrode, a criterion voltage is supplied to the lower electrode, and whether or not the drive signal is supplied is controlled by a selection circuit (switching circuit).

In the liquid ejecting apparatus that ejects an ink based on the displacement of the piezoelectric element as disclosed in JP-A-2017-43007, in a case where a not-intended voltage is supplied to the piezoelectric element, the piezoelectric element may perform displacement without an intention. In a case where the piezoelectric element performs not-intended displacement, a vibration plate also performs displacement based on the not-intended displacement of the piezoelectric element. As a result, the vibration plate performs displacement larger than expected, and thus not-intended stress is applied to the vibration plate.

In a case where the not-intended stress as described above is applied to the vibration plate for a long term, the stress may concentrate on a contact point between the vibration plate and the cavity as a center, and thus cracks may occur in the vibration plate.

Further, in a case where the vibration plate transitions from a state of performing not-intended displacement to an ejection operation, a larger load than necessary may be applied to the vibration plate, and cracks may occur in the vibration plate by the load.

If a crack occurs in the vibration plate, an ink stored in the cavity is leaked from the crack, and thus the amount of the ejected ink varies depending on a change of the volume of the cavity. As a result, ejection accuracy of the ink is deteriorated.

In particular, the criterion voltage supplied to the lower electrode may be commonly supplied to the plurality of piezoelectric elements in the print head. Thus, in a case where the criterion voltage has a not-intended potential, the criterion voltage influences displacement of the plurality of piezoelectric elements 60 and displacement of the vibration plate 621. That is, cracks may occur in a plurality of vibration plates 621 and thereby may influence ejection accuracy of the entirety of the liquid ejecting apparatus.

A problem of displacement of the piezoelectric element and the vibration plate occurring by applying a not-intended voltage to the piezoelectric element, as described above, is a new problem which has not been disclosed in JP-A-2017-43007.

SUMMARY

According to an aspect of the invention, a liquid ejecting apparatus includes a drive circuit that outputs a drive signal from a drive-signal output terminal, a criterion voltage circuit that outputs a criterion voltage signal from a criterion voltage-signal output terminal, a piezoelectric element that includes a first electrode to which the drive signal is supplied and a second electrode to which the criterion voltage signal is supplied, and that performs displacement by a potential difference between the first electrode and the second electrode, a cavity filled with a liquid being ejected from a nozzle by the displacement of the piezoelectric element, and a vibration plate which is provided between the cavity and the piezoelectric element. The criterion voltage circuit includes a voltage generation unit that generates the criterion voltage signal, and a voltage detection unit that detects a voltage value of the criterion voltage signal. In a case where the voltage value of the criterion voltage signal is greater than a first threshold, the voltage detection unit stops an operation of the voltage generation unit and electrically connects the criterion voltage-signal output terminal and a ground terminal to each other.

In the liquid ejecting apparatus, the criterion voltage circuit may include a first switching circuit that performs switching of whether or not a power-supply voltage is supplied to the voltage generation unit, and a second switching circuit that performs switching of whether or not the criterion voltage-signal output terminal and the ground terminal are electrically connected to each other. In a case where the voltage value of the criterion voltage signal is greater than the first threshold, the voltage detection unit may output a stop signal. The first switching circuit may stop a supply of the power-supply voltage to the voltage generation unit, based on the stop signal. The second switching circuit may electrically connect the criterion voltage-signal output terminal and the ground terminal to each other, based on the stop signal.

In the liquid ejecting apparatus, the voltage generation unit may include a first comparator that compares a first reference voltage and a signal based on the criterion voltage signal to each other, and a first transistor that performs switching of whether or not the power supply terminal and the criterion voltage-signal output terminal are electrically connected to each other, based on a comparison result of the first comparator. In a case where the voltage value of the criterion voltage signal is greater than the first threshold, the first switching circuit may stop a supply of the power-supply voltage to the first comparator, based on the stop signal.

In the liquid ejecting apparatus, the criterion voltage circuit may include a clamp circuit. In a case where the voltage value of the criterion voltage signal is greater than a second threshold lower than the first threshold, the clamp circuit may electrically connect the criterion voltage-signal output terminal and the ground terminal to each other.

In the liquid ejecting apparatus, the clamp circuit may include a second comparator that compares a second reference voltage and a signal based on the criterion voltage signal to each other, and a second transistor that performs switching of whether or not the criterion voltage-signal output terminal and the ground terminal are electrically connected to each other, based on a comparison result of the second comparator. In a case where the voltage value of the criterion voltage signal is greater than the second threshold, the second transistor may electrically connect the criterion voltage-signal output terminal and the ground terminal to each other.

According to another aspect of the invention, a liquid ejecting apparatus includes a drive circuit that outputs a drive signal from a drive-signal output terminal, a criterion voltage circuit that outputs a criterion voltage signal from a criterion voltage-signal output terminal, a piezoelectric element that includes a first electrode to which the drive signal is supplied and a second electrode to which the criterion voltage signal is supplied, and that performs displacement by a potential difference between the first electrode and the second electrode, a cavity which is filled with a liquid being ejected from a nozzle by the displacement of the piezoelectric element, a vibration plate which is provided between the cavity and the piezoelectric element, and a switching circuit that includes a first terminal to which the drive signal is supplied and a second terminal which is electrically connected to the first electrode, and that controls a supply of the drive signal to the first electrode. The criterion voltage circuit includes a voltage generation unit that generates the criterion voltage signal, and a voltage detection unit that detects a voltage value of the criterion voltage signal. In a case where the voltage value of the criterion voltage signal is greater than a first threshold, the voltage detection unit stops an operation of the voltage generation unit and releases charges at a first node via a parasitic diode of the switching circuit. The first electrode and the second terminal are electrically connected at the first node.

In the liquid ejecting apparatus, in a case where the voltage value of the criterion voltage signal is greater than the first threshold, charges at a second node at which the drive-signal output terminal and the first terminal are electrically connected may be discharged.

According to still another aspect of the invention, a liquid ejecting apparatus includes a drive circuit that outputs a drive signal from a drive-signal output terminal, a criterion voltage circuit that outputs a criterion voltage signal from a criterion voltage-signal output terminal, a piezoelectric element that includes a first electrode to which the drive signal is supplied and a second electrode to which the criterion voltage signal is supplied, and that performs displacement by a potential difference between the first electrode and the second electrode, a cavity which is filled with a liquid being ejected from a nozzle by the displacement of the piezoelectric element; and a vibration plate which is provided between the cavity and the piezoelectric element. The criterion voltage circuit includes a first discharge transistor and a second discharge transistor having rated capacity larger than that of the first discharge transistor. One end of the first discharge transistor and one end of the second discharge transistor are electrically connected to the criterion voltage-signal output terminal. Another end of the first discharge transistor and another end of the second discharge transistor are electrically connected to a ground terminal.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a preferred embodiment of the invention will be described with reference to the drawings. The drawings are used for easy descriptions. The embodiment described below does not unduly limit the contents of the invention described in the claims. Also, not all of the components described below are necessarily essential components of the invention.

An ink jet printer which is a printing device that ejects an ink as a liquid will be described below, as an example of a liquid ejecting apparatus according to the invention.

Examples of the liquid ejecting apparatus may include a printing device such as an ink jet printer; a coloring-material ejecting apparatus used in manufacturing a color filter in a liquid crystal display or the like; an electrode-material ejecting apparatus used in forming an electrode in an organic EL display, a surface-emitting display, or the like; and a bio-organic material ejecting apparatus used in manufacturing a biochip.

1. Configuration of Liquid Ejecting Apparatus

A printing device as an example of the liquid ejecting apparatus according to the embodiment is an ink jet printer that performs printing of an image which includes a figure, characters, and the like and corresponds to image data, in a manner that a dot is formed on a print medium such as paper by ejecting an ink in accordance with the image data supplied from an external host computer.

Figure 1:
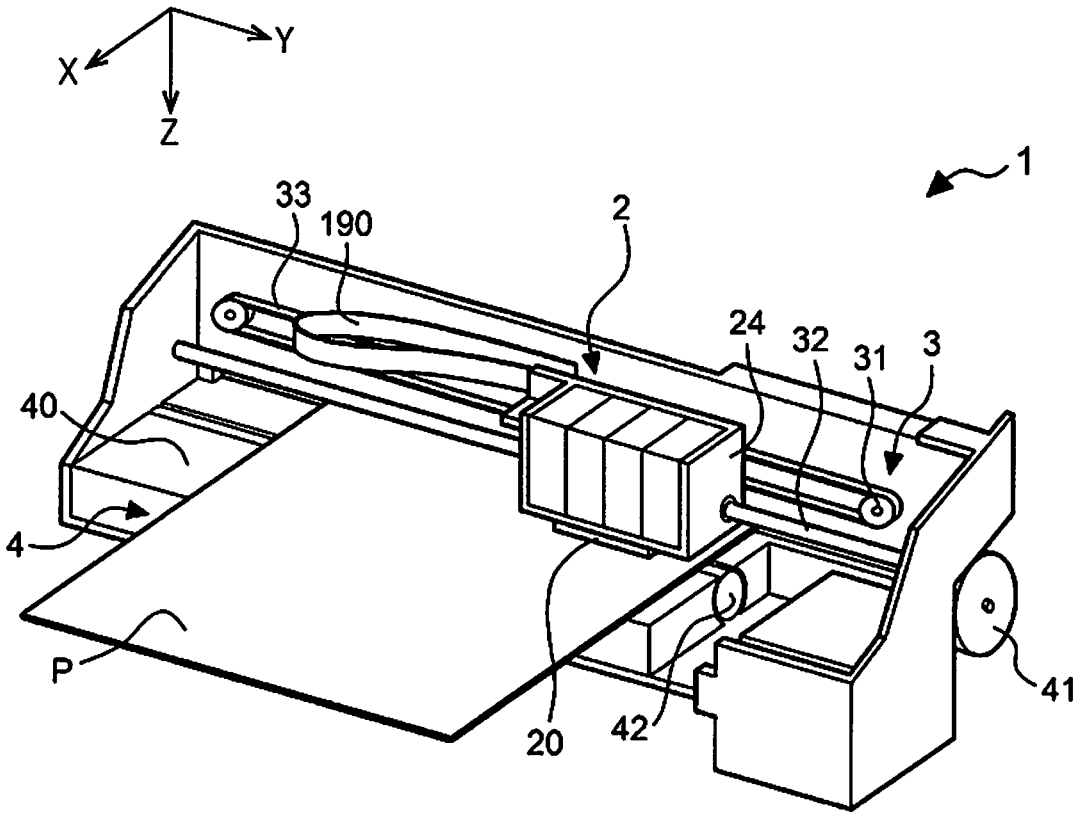
FIG. 1 is a perspective view illustrating an overall configuration of a liquid ejecting apparatus.

FIG. 1 is a perspective view illustrating an overall configuration of a liquid ejecting apparatus 1. FIG. 1 illustrates a direction X in which a medium P is transported, a direction Y which intersects with the direction X and in which a moving object 2 performs reciprocation, and a direction Z in which an ink is ejected. In the embodiment, descriptions will be made on the assumption that the direction X, the direction Y, and the direction Z correspond to axes orthogonal to each other.

As illustrated in FIG. 1, the liquid ejecting apparatus 1 includes the moving object 2 and a moving mechanism 3 that cause the moving object 2 to reciprocate in the direction Y.

The moving mechanism 3 includes a carriage motor 31 as a driving source of the moving object 2, a carriage guide shaft 32 having both fixed ends, and a timing belt 33 that extends substantially parallel to the carriage guide shaft 32 and is driven by the carriage motor 31.

A carriage 24 provided in the moving object 2 is supported by the carriage guide shaft 32 so as to freely reciprocate and is fixed to a portion of the timing belt 33. Therefore, if the timing belt 33 is driven by the carriage motor 31, the moving object 2 reciprocates in the direction Y with being guided by the carriage guide shaft 32.

A head unit 20 is provided at a portion of the moving object 2, which faces a medium P. The head unit 20 includes multiple nozzles. An ink is ejected from each of the nozzles in the direction Z. A control signal and the like are supplied to the head unit 20 via a flexible cable 190.

The liquid ejecting apparatus 1 includes a transport mechanism 4 that transports a medium P on a platen 40 in the direction X. The transport mechanism 4 includes a transport motor 41 as a driving source and a transport roller 42 that rotates by the transport motor 41 so as to transport the medium P in the direction X.

The head unit 20 ejects an ink onto a medium P at a timing at which the medium P is transported by the transport mechanism 4, and thereby an image is formed on a surface of the medium P.

Figure 2:
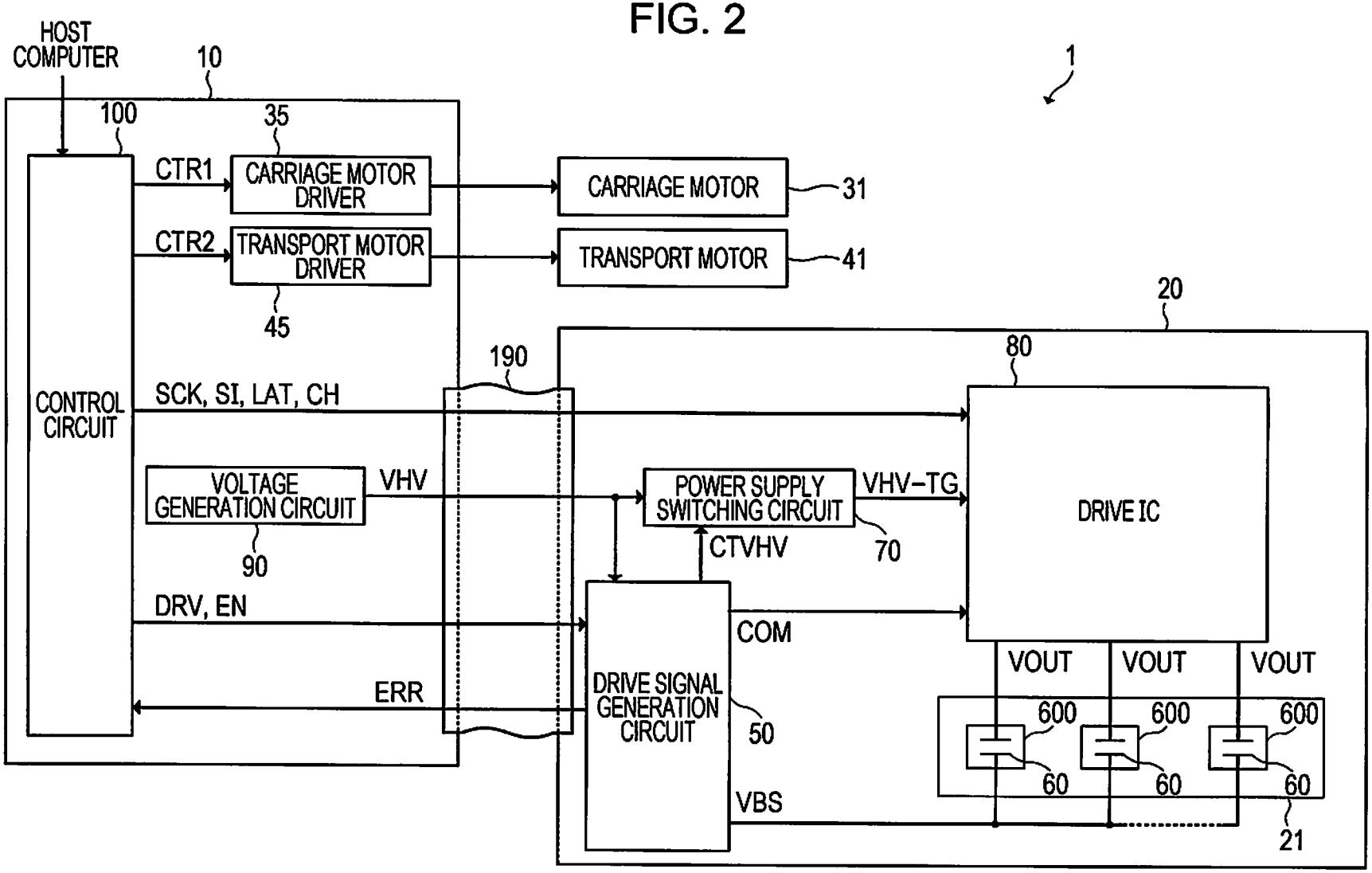
FIG. 2 is a block diagram illustrating an electrical configuration of the liquid ejecting apparatus.

FIG. 2 is a block diagram illustrating an electrical configuration of the liquid ejecting apparatus 1.

As illustrated in FIG. 2, the liquid ejecting apparatus 1 includes a control unit 10 and a head unit 20. The control unit 10 and the head unit 20 are connected to each other via the flexible cable 190.

The control unit 10 includes a control circuit 100, a carriage motor driver 35, a transport motor driver 45, and a voltage generation circuit 90.

The control circuit 100 supplies a plurality of control signals for controlling various components, based on image data supplied from the host computer.

Specifically, the control circuit 100 supplies a control signal CTR1 to the carriage motor driver 35. The carriage motor driver 35 drives the carriage motor 31 in accordance with the control signal CTR1. Thus, moving of the carriage 24 (illustrated in FIG. 1) in the direction Y is controlled.

The control circuit 100 supplies a control signal CTR2 to the transport motor driver 45. The transport motor driver 45 drives the transport motor 41 in accordance with the control signal CTR2. Thus, moving of the medium P by the transport mechanism 4 (illustrated in FIG. 1) in the direction X is controlled.

The control circuit 100 supplies a clock signal SCK, a print data signal SI, a latch signal LAT, a change signal CH, a drive data signal DRV, and a select signal EN to the head unit 20.

The voltage generation circuit 90 generates a voltage VHV having, for example, DC 42 V to the head unit 20. The voltage VHV may also be supplied to various components in the control unit 10.

The head unit 20 includes a drive signal generation circuit 50, a power supply switching circuit 70, a drive IC 80, and an ejection module 21.

The voltage VHV, the drive data signal DRV, and the select signal EN are supplied to the drive signal generation circuit 50.

The drive signal generation circuit 50 generates a drive signal COM by class-D amplifying a signal based on the drive data signal DRV to have a voltage based on the voltage VHV. Then, the drive signal generation circuit supplies the generated drive signal to the drive IC 80. The drive signal generation circuit 50 generates a criterion voltage signal VBS having, for example, DC 5 V by stepping down the voltage VHV, and supplies the generated criterion voltage signal to the ejection module 21. The drive signal generation circuit 50 generates a power-supply control signal CTVHV based on the drive data signal DRV and supplies the generated power-supply control signal to the power supply switching circuit 70. Here, the select signal EN is a signal for an instruction of whether the drive data signal DRV supplied to the drive signal generation circuit 50 is a data signal for generating the drive signal COM or a data signal for generating the power-supply control signal CTVHV.

In a case where the generated drive signal COM is not normal, the drive signal generation circuit 50 supplies an error signal ERR to the control circuit 100.

The voltage VHV and the power-supply control signal CTVHV are supplied to the power supply switching circuit 70. The power supply switching circuit 70 performs switching of whether the potential of a voltage VHV-TG supplied to the drive IC 80 has a potential based on the voltage VHV or has a ground potential, in accordance with the power-supply control signal CTVHV.

The clock signal SCK, the print data signal SI, the latch signal LAT, the change signal CH, the voltage VHV-TG, and the drive signal COM are supplied to the drive IC 80.

The drive IC 80 performs switching of whether or not the drive signal COM is selected in a predetermined period, based on the clock signal SCK, the print data signal SI, the latch signal LAT, and the change signal CH. The drive signal COM selected by the drive IC 80 is supplied to the ejection module 21 as a drive signal VOUT. The voltage VHV-TG is used for generating a signal of a high voltage logic, which is used for selecting the drive signal COM, for example.

The ejection module 21 includes a plurality of ejection units 600 including a piezoelectric element 60.

The drive signal VOUT supplied to the ejection module 21 is supplied to one end of the piezoelectric element 60. The criterion voltage signal VBS is supplied to the other end of the piezoelectric element 60. The piezoelectric element 60 performs displacement in accordance with a potential difference between the drive signal VOUT and the criterion voltage signal VBS. Thus, an ink of an amount depending on the displacement is ejected from the ejection unit 600.

Details of the drive signal generation circuit 50, the power supply switching circuit 70, the drive IC 80, and the ejection module 21 described above will be described later. FIG. 2 illustrates one head unit 20 provided in the liquid ejecting apparatus 1. However, a plurality of head units 20 may be provided. FIG. 2 illustrates one ejection module 21 provided in the head unit 20. However, a plurality of ejection modules 21 may be provided.

2. Configuration and Operation of Drive Signal Generation Circuit

Figure 3:
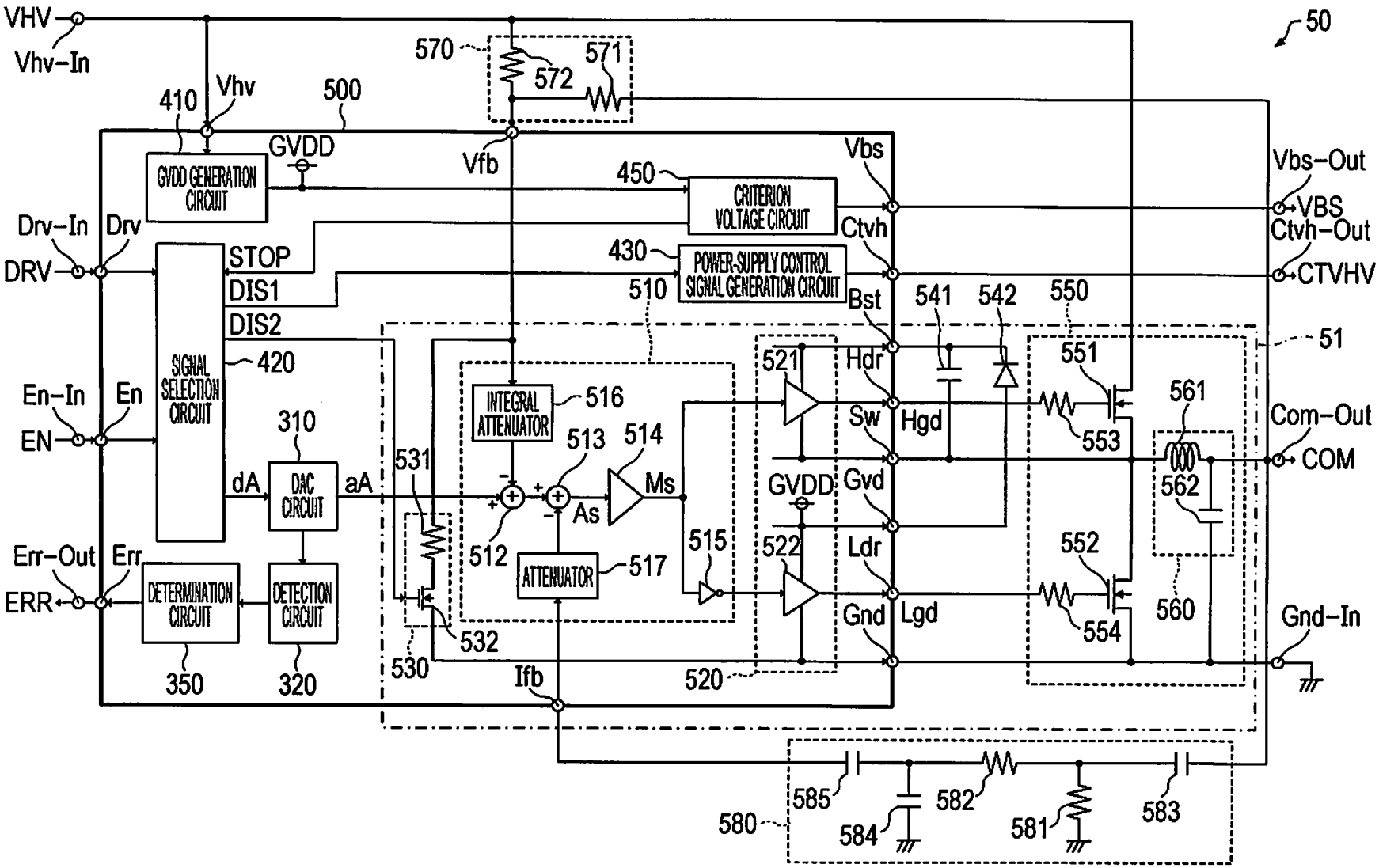
FIG. 3 is a block diagram illustrating a circuit configuration of a drive signal generation circuit.

Next, the drive signal generation circuit 50 will be described with reference to FIG. 3. FIG. 3 is a block diagram illustrating a circuit configuration of the drive signal generation circuit 50. As illustrated in FIG. 3, the drive signal generation circuit 50 includes an integrated circuit 500, an output circuit 550, a first feedback circuit 570, a second feedback circuit 580, and plurality of other circuit elements.

The drive signal generation circuit 50 has a plurality of terminals including terminals Drv-In, En-In, Err-Out, Vhv-In, Vbs-Out, Ctvh-Out, Com-Out, and Gnd-In, for electrical connections with various external components. A ground potential (for example, 0 V) is supplied to the terminal Gnd-In among the above terminals, in the liquid ejecting apparatus 1.

The integrated circuit 500 includes a GVDD generation circuit 410, a signal selection circuit 420, a power-supply control signal generation circuit 430, a criterion voltage circuit 450, a digital-to-analog converter (DAC) circuit 310, a detection circuit 320, a determination circuit 350, a modulation circuit 510, a gate drive circuit 520, and an LC discharge circuit 530.

The integrated circuit 500 has a plurality of terminals including terminals Drv, En, Err, Vhv, Vfb, Vbs, Ctvh, Bst, Hdr, Sw, Gvd, Ldr, and Gnd for electrical connections with various components of the drive signal generation circuit 50.

The voltage VHV is supplied to the GVDD generation circuit 410 via the terminal Vhv-In and the terminal Vhv. The GVDD generation circuit 410 generates a voltage GVDD by changing the voltage of the voltage VHV and supplies the generated voltage GVDD to the criterion voltage circuit 450 and the gate drive circuit 520.

The GVDD generation circuit 410 is constituted by, for example, a linear regulator circuit or a switching regulator circuit. The GVDD generation circuit 410 may be provided on the outside of the integrated circuit 500.

The drive data signal DRV is supplied to the signal selection circuit 420 via the terminal Drv-In and the terminal Drv, and the select signal EN is supplied to the signal selection circuit 420 via the terminal En-In and the terminal En. The signal selection circuit 420 determines whether the drive data signal DRV is a signal to be supplied to the DAC circuit 310 or a signal to be supplied to each of the power-supply control signal generation circuit 430 and the LC discharge circuit 530, based on the select signal EN. Then, the signal selection circuit supplies the drive data signal to the corresponding component.

Specifically, the signal selection circuit 420 includes a plurality of registers (not illustrated). In a case where the drive data signal DRV is a signal to be supplied to the DAC circuit 310, the signal selection circuit 420 holds the drive data signal DRV in a plurality of registers corresponding to the DAC circuit 310, in accordance with the select signal EN. The signal selection circuit 420 supplies the held signal as an original digital drive signal dA to the DAC circuit 310.

In a case where the drive data signal DRV is a signal to be supplied to each of the power-supply control signal generation circuit 430 and the LC discharge circuit 530, the signal selection circuit 420 holds data of the drive data signal DRV, which corresponds to each of the power-supply control signal generation circuit 430 and the LC discharge circuit 530, in a predetermined register in accordance with the select signal EN. The signal selection circuit 420 supplies the held signal as discharge control signals DIS1 and DIS2 to the power-supply control signal generation circuit 430 and the LC discharge circuit 530, respectively.

A control signal STOP is supplied from the criterion voltage circuit 450 to the signal selection circuit 420. In a case where the control signal STOP is supplied, the signal selection circuit 420 holds predetermined data corresponding to each of the power-supply control signal generation circuit 430 and the LC discharge circuit 530 in a predetermined register regardless of the drive data signal DRV and the select signal EN. The signal selection circuit 420 supplies the held signal as discharge control signals DIS1 and DIS2 to the power-supply control signal generation circuit 430 and the LC discharge circuit 530, respectively. In a case where the control signal STOP is supplied to the signal selection circuit 420, the drive signal generation circuit 50 stops generation of the drive signal COM. Details of the control signal STOP will be described later.

The discharge control signal DIS1 is supplied to the power-supply control signal generation circuit 430. The power-supply control signal generation circuit 430 includes an open drain circuit (not illustrated). In a case where the supplied discharge control signal DIS1 indicates being active, the power-supply control signal generation circuit 430 controls the open drain circuit to be in an OFF state and sets the terminal Ctvh to have high impedance.

In a case where the discharge control signal DIS1 indicates being inactive, the power-supply control signal generation circuit 430 controls the open drain circuit to be in an ON state and sets the terminal Ctvh to have a ground potential. At this time, the power-supply control signal CTVHV having an L level is supplied to the power supply switching circuit 70 illustrated in FIG. 2 via the terminal Ctvh and the terminal Ctvh-Out.

In descriptions of FIG. 22 and the like, which will be made later, the descriptions will be made on the assumption that the open drain circuit in the power-supply control signal generation circuit 430 is constituted by an NMOS transistor. The descriptions will be made on the assumption that the discharge control signal DIS1 is supplied to a gate terminal of the NMOS transistor via an inverter circuit. Thus, in the embodiment, descriptions will be made on the assumption that a signal indicating that the discharge control signal DIS1 is active is a signal having an H level, and a signal indicating that the discharge control signal DIS1 is inactive is a signal having an L level. The power-supply control signal generation circuit 430 is not limited to the open drain circuit and may be constituted by a push-pull circuit.

The voltage GVDD is supplied to the criterion voltage circuit 450. The criterion voltage circuit 450 generates the criterion voltage signal VBS by stepping down the supplied voltage GVDD.

The criterion voltage signal VBS generated by the criterion voltage circuit 450 is supplied to the ejection module 21 illustrated in FIG. 2 via the terminal Vbs and the terminal Vbs-Out. The criterion voltage signal VBS functions as a criterion voltage used as a reference causing the piezoelectric element 60 to perform displacement.

The DAC circuit 310 converts the original drive signal dA into an original analog drive signal aA and supplies the original analog drive signal to the modulation circuit 510. The DAC circuit 310 supplies a digital signal based on the original drive signal dA to the detection circuit 320.

The detection circuit 320 determines whether or not the signal which is based on the original drive signal dA and is supplied from the DAC circuit 310 is within a predetermined range.

The determination circuit 350 determines whether or not the original drive signal dA is normal, in accordance with a detection result of the detection circuit 320. In a case where it is determined that the original drive signal dA is not normal, the determination circuit 350 generates the error signal ERR and supplies the generated error signal ERR to the control circuit 100 illustrated in FIG. 2 via the terminal Err and the terminal Err-Out.

The modulation circuit 510 includes an adder 512, an adder 513, a comparator 514, an inverter 515, an integral attenuator 516, and an attenuator 517.

The integral attenuator 516 attenuates and integrates a voltage signal of the drive signal COM supplied via the terminal Vfb, and then supplies the voltage signal to an input end (−) of the adder 512.

The original drive signal aA is supplied to the input end (+) of the adder 512. The adder 512 subtracts a voltage signal supplied from the integral attenuator 516 to the input end (−) of the adder 512, from the original drive signal aA supplied to the input end (+) thereof. Then, the adder 512 performs integration. A voltage signal obtained by the subtraction and the integration is supplied to the input end (+) of the adder 513.

Here, although the maximum voltage of the original drive signal aA is a low voltage of, for example, about 2 V, the maximum voltage of the drive signal COM is a high voltage of, for example, about 40 V. Therefore, the integral attenuator 516 attenuates the voltage of the drive signal COM in order to cause the amplitude ranges of both the voltage to match with each other when the deviation is obtained.

The attenuator 517 attenuates a high-frequency component of the voltage signal of the drive signal COM input via the terminal Ifb and supplies the voltage to the input end (−) of the adder 513.

The adder 513 subtracts a voltage supplied from the attenuator 517 to the input end (−), from the voltage supplied from the adder 512 to the input end (+), and outputs a voltage signal As as a result of the subtraction to the comparator 514.

The voltage signal As output from the adder 513 is a voltage obtained by subtracting the voltage supplied to the terminal Vfb from the voltage of the original drive signal aA and further subtracting the voltage supplied to the terminal Ifb. That is, the voltage signal As is a voltage signal obtained in a manner that a deviation obtained by subtracting an attenuation voltage of the drive signal COM to be output, from the voltage of the aimed original drive signal aA is corrected with the high-frequency component of the drive signal COM.

The comparator 514 generates a modulation signal Ms based on the voltage signal As supplied from the adder 513. Specifically, in a case where the voltage of the voltage signal As supplied from the adder 513 rises and is equal to or higher than a predetermined threshold Vth1, the comparator 514 generates a modulation signal Ms having an H level. In a case where the voltage of the voltage signal As is lowered and is lower than a predetermined threshold Vth2, the comparator 514 generates a modulation signal Ms having an L level. The threshold Vth1 and the threshold Vth2 are set to have a relationship of threshold Vth1>threshold Vth2.

The comparator 514 supplies the generated modulation signal Ms to a first gate driver 521 provided in the gate drive circuit 520. The comparator 514 supplies the generated modulation signal Ms to a second gate driver 522 provided in the gate drive circuit 520, via an inverter 515. Thus, a signal supplied from the comparator 514 to the first gate driver 521 and a signal supplied to the second gate driver 522 have logical levels which have an exclusive relationship.

Here, the phrase that the logical levels of the signals supplied to the first gate driver 521 and the second gate driver 522 have an exclusive relationship includes a concept that a timing is controlled such that the logical levels of the signals supplied to the first gate driver 521 and the second gate driver 522 do not have simultaneously an H level.

The gate drive circuit 520 includes the first gate driver 521 and the second gate driver 522.

The first gate driver 521 shifts the level of the voltage of the modulation signal Ms output from the comparator 514 and then outputs a signal obtained by the shift from the terminal Hdr as a first amplification control signal Hgd.

Specifically, a voltage is supplied to a high-potential side of the power-supply voltage of the first gate driver 521 via the terminal Bst, and a voltage is supplied to a low-potential side via the terminal Sw. The terminal Bst is commonly connected to one end of a capacitor 541 provided on the outside of the integrated circuit 500 and a cathode terminal of a diode 542 for preventing a backflow. The other end of the capacitor 541 is connected to the terminal Sw. The anode terminal of the diode 542 is connected to the terminal Gvd to which the voltage GVDD is supplied. Thus, a potential difference between the terminal Bst and the terminal Sw is substantially equal to a potential difference between both the ends of the capacitor 541, that is, the voltage GVDD. The first gate driver 521 generates the first amplification control signal Hgd having a voltage larger than the voltage at the terminal Sw by the voltage GVDD, in accordance with the input modulation signal Ms. Then, the first gate driver outputs the generated first amplification control signal from the terminal Hdr.

The second gate driver 522 operates on a potential side lower than the first gate driver 521. The second gate driver 522 shifts a level of a voltage of a signal obtained by the inverter 515 inverting the modulation signal Ms output from the comparator 514. Then, the second gate driver outputs a signal obtained by the shift, from the terminal Ldr as a second amplification control signal Lgd.

Specifically, the voltage GVDD is supplied to a high-potential side of the power-supply voltage of the second gate driver 522, and the ground potential is supplied to a low-potential side. The second gate driver 522 generates the second amplification control signal Lgd having a voltage which is larger than the voltage at the terminal Gnd by the voltage GVDD, in accordance with the inverted signal of the supplied modulation signal Ms. Then, the second gate driver outputs the second amplification control signal from the terminal Ldr.

The LC discharge circuit 530 includes a resistor 531 and a transistor 532. Descriptions will be made below on the assumption that the transistor 532 is an NMOS transistor.

One end of the resistor 531 is connected to the terminal Vfb. The other end of the resistor 531 is connected to a drain terminal of the transistor 532.

The discharge control signal DIS2 is supplied to a gate terminal of the transistor 532. The ground potential is supplied to a source terminal of the transistor 532.

In a case where the discharge control signal DIS2 having an H level is supplied to the gate terminal of the transistor 532, the transistor 532 is controlled to turn into the ON state. At this time, the ground potential is supplied to the terminal Com-Out to which the drive signal COM is output, via resistors 531 and 571 and the transistor 532. In other words, the transistor 532 is provided to be capable of switching an electrical connection between the terminal Com-Out and the ground potential.

The output circuit 550 includes transistors 551 and 552, resistors 553 and 554, and a low pass filter 560. Descriptions will be made below on the assumption that the transistors 551 and 552 are NMOS transistors.

The voltage VHV is supplied to a drain terminal of the transistor 551. A gate terminal of the transistor 551 is connected to one end of the resistor 553. A source terminal of the transistor 551 is connected to the terminal Sw. The other end of the resistor 553 is connected to the terminal Hdr. Thus, the first amplification control signal Hgd is supplied to the gate terminal of the transistor 551.

A drain terminal of the transistor 552 is connected to the source terminal of the transistor 551. A gate terminal of the transistor 552 is connected to one end of the resistor 554. The ground potential is supplied to a source terminal of the transistor 552. The other end of the resistor 554 is connected to the terminal Ldr. Thus, the second amplification control signal Lgd is supplied to the gate terminal of the transistor 552.

In the transistors 551 and 552 connected in the above-described manner, in a case where the transistor 551 is controlled to be in the OFF state, and the transistor 552 is controlled to be in the ON state, a connection point connected to the terminal Sw has the ground potential, and the voltage GVDD is supplied to the terminal Bst. In a case where the transistor 551 is controlled to be in the ON state, and the transistor 552 is controlled to be in the OFF state, the voltage VHV is supplied to the connection point connected to the terminal Sw. Thus, a voltage obtained by adding the voltage VHV and the voltage GVDD is supplied to the terminal Bst. That is, the voltage of the terminal Sw changes to the ground potential and the voltage VHV in accordance with operations of the transistors 551 and 552, by using the capacitor 541 as a floating power supply. Thereby, the first gate driver 521 that drives the transistor 551 supplies the first amplification control signal Hgd having the voltage VHV as an L level and the voltage of the voltage VHV+ the voltage GVDD as an H level, to the gate terminal of the transistor 551. The transistor 551 performs a switching operation based on the first amplification control signal Hgd.

The second gate driver 522 that drives the transistor 552 outputs the second amplification control signal Lgd having the ground potential as an L level and the voltage GVDD as an H level, regardless of the operations of the transistors 551 and 552. The transistor 552 performs a switching operation based on the second amplification control signal Lgd.

Accordingly, an amplification modulation signal obtained by amplifying the modulation signal Ms based on the voltage VHV is generated at the connection point between the source terminal of the transistor 551 and the drain terminal of the transistor 552. That is, the transistors 551 and 552 function as an amplification circuit that amplifies the voltage of the modulation signal Ms. As described above, the first amplification control signal Hgd and the second amplification control signal Lgd for driving the transistors 551 and 552 have an exclusive relationship. That is, the transistor 551 and the transistor 552 are controlled not to simultaneously in the ON state.

The low pass filter 560 includes an inductor 561 and a capacitor 562.

One end of the inductor 561 is commonly connected to the source terminal of the transistor 551 and the drain terminal of the transistor 552. The other end of the inductor 561 is commonly connected to the terminal Com-Out from which the drive signal COM is output and one end of the capacitor 562. The ground potential is supplied to the other end of the capacitor 562.

In this manner, the inductor 561 and the capacitor 562 smooth the amplification modulation signal supplied to the connection point between the transistor 551 and the transistor 552. Thus, the drive signal COM is generated by demodulating the amplification modulation signal.

The first feedback circuit 570 includes a resistor 571 and a resistor 572. One end of the resistor 571 is connected to the terminal Com-Out. The other end of the resistor 571 is commonly connected to the terminal Vfb and one end of the resistor 572. The voltage VHV is supplied to the other end of the resistor 572. Thus, the drive signal COM passing from the terminal Com-Out through the first feedback circuit 570 is pulled up and then is fed back to the terminal Vfb.

The second feedback circuit 580 includes resistors 581 and 582 and capacitors 583, 584, and 585.

One end of the capacitor 583 is connected to the terminal Com-Out. The other end of the capacitor 583 is commonly connected to one end of the resistor 581 and one end of the resistor 582. The ground potential is supplied to the other end of the resistor 581. Thus, the capacitor 583 and the resistor 581 function as a high pass filter. The cutoff frequency of the high pass filter constituted by the capacitor 583 and the resistor 581 is set to about 9 MHz, for example.

The other end of the resistor 582 is commonly connected to one end of the capacitor 584 and one end of the capacitor 585. The ground potential is supplied to the other end of the capacitor 584. Thus, the resistor 582 and the capacitor 584 function as a low pass filter. The cutoff frequency of the high pass filter constituted by the resistor 582 and the capacitor 584 is set to about 160 MHz, for example.

As described above, the second feedback circuit 580 is constituted by the high pass filter and the low pass filter. Thus, the second feedback circuit 580 functions as a band pass filter that causes a predetermined frequency band of the drive signal COM to pass therethrough.

The other end of the capacitor 585 is connected to the terminal Ifb. Thus, a DC component is cut off from the high-frequency component of the drive signal COM by the drive signal passing through the second feedback circuit 580, and the resultant of the cutoff is fed back to the terminal Ifb.

The drive signal COM is a signal obtained by smoothing the amplification modulation signal with the low pass filter 560. The drive signal COM is fed back to the adder 512 in a state of being integrated and subtracted via the terminal Vfb. Thus, self-oscillation occurs at a frequency determined by a feedback delay and a feedback transfer function. However, the delay degree of a feedback path via the terminal Vfb is large. Thus, it may not possible that the frequency of the self-oscillation is set to be as high as accuracy of the drive signal COM can be sufficiently secured, only by the feedback via the terminal Vfb. Thus, a path of feeding a high-frequency component of the drive signal COM via the terminal Ifb is provided in addition to the path via the terminal Vfb, and thereby it is possible to reduce the delay in the entirety of the circuit. Accordingly, the frequency of the voltage signal As is set to be as high as the accuracy of the drive signal COM can be sufficiently secured, in comparison to a case where the path via the terminal Ifb is not provided.

In the above-described drive signal generation circuit 50, the configuration including the modulation circuit 510, the gate drive circuit 520, the LC discharge circuit 530, the output circuit 550, the capacitor 541, and the diode 542 corresponds to the drive circuit 51 that generates the drive signal COM. The terminal Com-Out corresponds to a terminal for outputting the drive signal COM generated by the drive circuit 51 and is an example of "a drive-signal output terminal".

3. Configuration and Operation of Power Supply Switching Circuit

Figure 4:
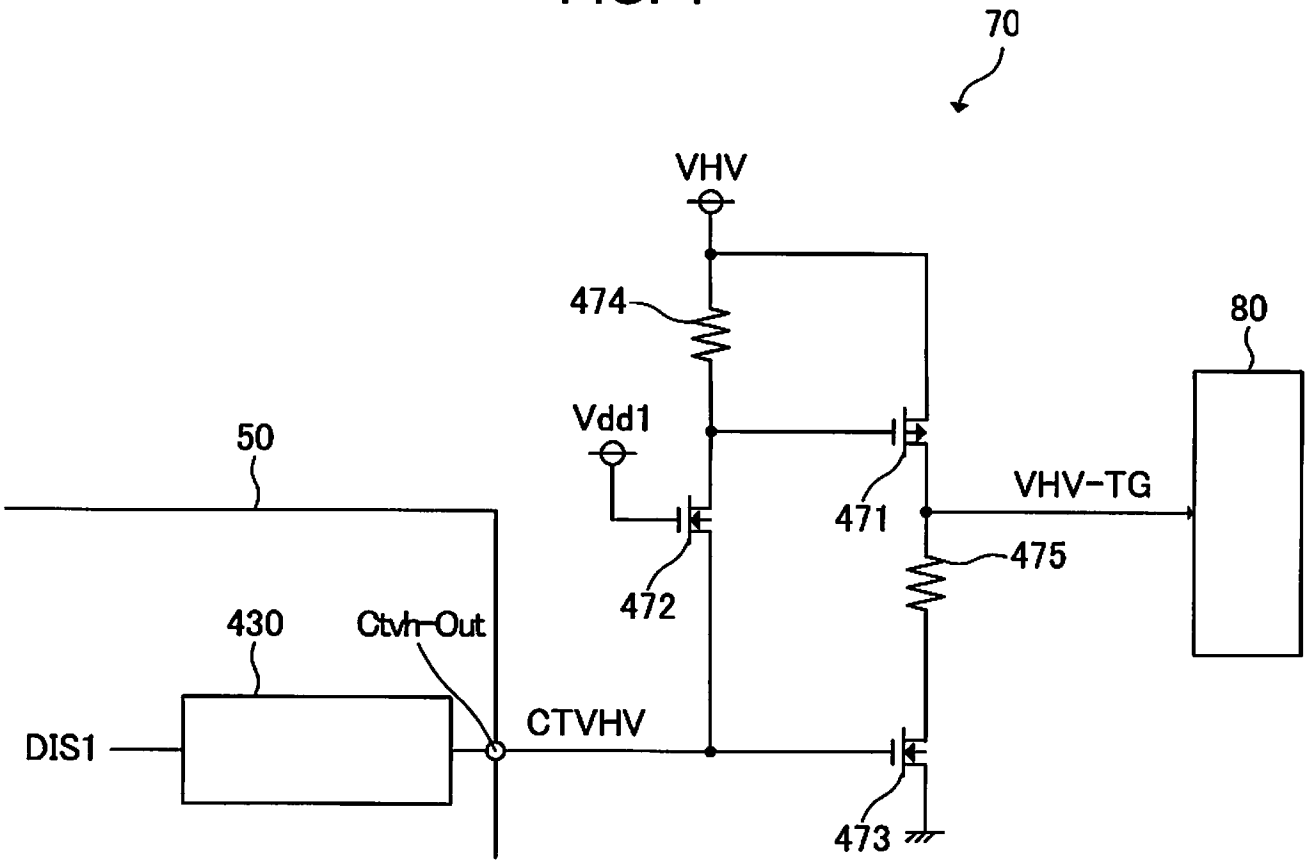
FIG. 4 is a circuit diagram illustrating an electrical configuration of a power supply switching circuit.

Next, a configuration and an operation of the power supply switching circuit 70 will be described with reference to FIG. 4. FIG. 4 is a circuit diagram illustrating an electrical configuration of the power supply switching circuit 70.

The power supply switching circuit 70 includes transistors 471, 472, and 473 and resistors 474 and 475. Descriptions will be made below on the assumption that the transistor 471 is a PMOS transistor, and the transistors 472 and 473 are NMOS transistors.

The voltage VHV is supplied to a source terminal of the transistor 471 and one end of the resistor 474. A gate terminal of the transistor 471 is commonly connected to the other end of the resistor 474 and a drain terminal of the transistor 472. A drain terminal of the transistor 471 is connected to one end of the resistor 475.

A voltage Vdd1 is supplied to a gate terminal of the transistor 472. A source terminal of the transistor 472 is connected to a gate terminal of the transistor 473. The power-supply control signal CTVHV is supplied to the source terminal of the transistor 472. Here, the voltage Vdd1 is a DC voltage signal having a predetermined voltage.

A drain terminal of the transistor 473 is connected to the other end of the resistor 475. The ground potential is supplied to a source terminal of the transistor 473.

The power supply switching circuit 70 constituted as described above performs switching of whether or not the voltage VHV is supplied to the drive IC 80 as the voltage VHV-TG, in accordance with the power-supply control signal CTVHV supplied from the drive signal generation circuit 50.

Specifically, in a case where the discharge control signal DIS1 indicating being inactive is supplied to the power-supply Control signal generation circuit 430, the power-supply control signal generation circuit 430 sets the terminal Ctvh-Out to have a ground potential. Thus, the power-supply control signal CTVHV becomes a signal having an L level. Thus, the transistor 473 is controlled to be in the OFF state, and the transistor 472 is controlled to be in the ON state. Thus, the ground potential is supplied to the gate terminal of the transistor 471 via the transistor 472. Accordingly, the transistor 471 is controlled to be in the ON state.

As described above, in a case where the power-supply control signal CTVHV is a signal having an L level, the transistor 471 is controlled to be in the ON state, and the transistor 473 is controlled to be in the OFF state. Thus, the power supply switching circuit 70 supplies the voltage VHV supplied via the transistor 471, to the drive IC 80 as the voltage VHV-TG.

In a case where the discharge control signal DIS1 indicating being active is supplied to the power-supply control signal generation circuit 430, the power-supply control signal generation circuit 430 sets the terminal Ctvh-Out to have high impedance. At this time, the voltage at the terminal Ctvh-Out is the voltage Vdd1 supplied via the transistor 472. In other words, the power-supply control signal CTVHV becomes a signal having an H level. Thus, the transistor 473 is controlled to be in the ON state. At this time, the voltage VHV is supplied to the drain terminal of the transistor 472 and the gate terminal of the transistor 471 via the resistor 474. Thus, the transistor 471 is controlled to be in the OFF state.

As described above, in a case where the power-supply control signal CTVHV is a signal having an H level, the transistor 471 is controlled to be in the OFF state, and the transistor 473 is controlled to be in the ON state. Accordingly, the power supply switching circuit 70 supplies the ground potential supplied via the resistor 475 and the transistor 472, to the drive IC 80 as the voltage VHV-TG.

4. Configuration and Operation of Drive IC

Next, a configuration and an operation of the drive IC 80 will be described.

Firstly, an example of the drive signal COM supplied to the drive IC 80 will be described with reference to FIG. 5. Then, the configuration and the operation of the drive IC 80 will be described with reference to FIGS. 6 to 9.

Figure 5:
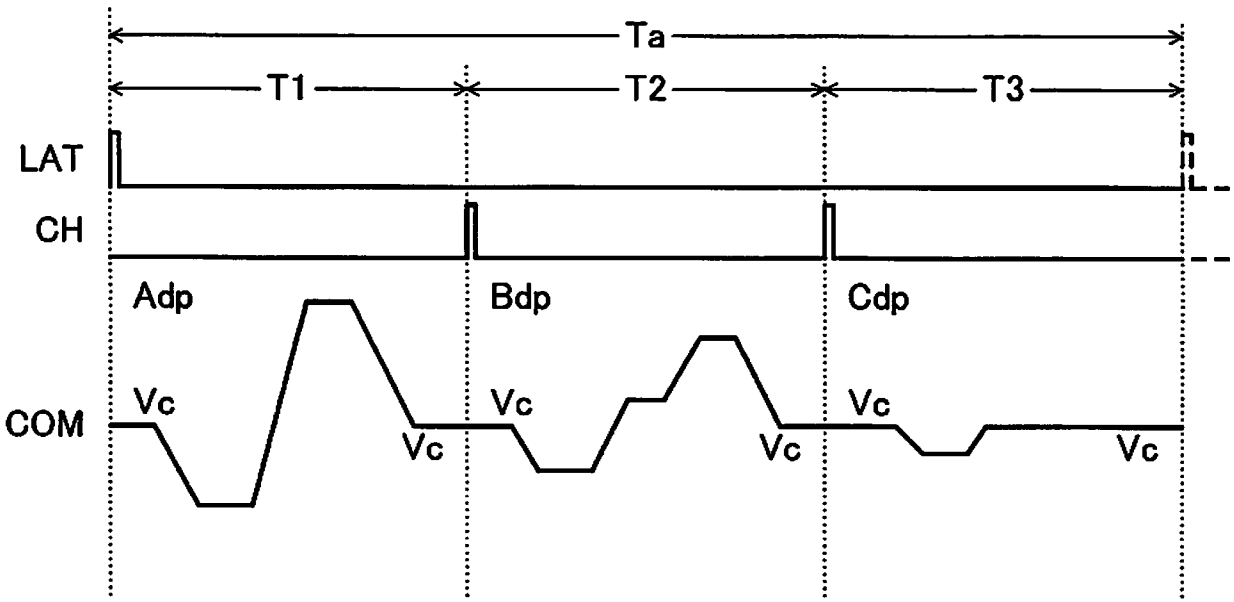
FIG. 5 is a diagram illustrating an example of a drive signal.

FIG. 5 is a diagram illustrating an example of the drive signal COM. FIG. 5 illustrates a period T1, a period T2, and a period T3. The period T1 is a period from a rising edge of the latch signal LAT to a rising edge of the change signal CH. The period T2 is a period until the next rising edge of the change signal CH after the period T1. The period T3 is a period until a rising edge of the latch signal LAT after the period T2. A cycle including the periods T1, T2, and T3 is set as a cycle Ta at which a new dot is formed on a medium P.

As illustrated in FIG. 5, the drive signal generation circuit 50 generates a voltage waveform Adp in the period T1. In a case where the voltage waveform Adp1 is supplied to the piezoelectric element 60, an ink of a predetermined amount, specifically, a median amount is ejected from the corresponding ejection unit 600.

The drive signal generation circuit 50 generates a voltage waveform Bdp in the period T2. In a case where the voltage waveform Bdp is supplied to the piezoelectric element 60, the ink of a small amount which is smaller than the predetermined amount is ejected from the corresponding ejection unit 600.

The drive signal generation circuit 50 generates a voltage waveform Cdp in the period T3. In a case where the voltage waveform Cdp is supplied to the piezoelectric element 60, the piezoelectric element 60 performs displacement as small as the ink is not ejected from the corresponding ejection unit 600. Thus, a dot is not formed on the medium P. The voltage waveform Cdp is a voltage waveform for preventing an increase of viscosity of an ink by finely vibrating the ink in the vicinity of an aperture portion of a nozzle in the ejection unit 600. In the following descriptions, causing the piezoelectric element 60 to perform displacement as much as the ink is not ejected from the ejection unit 600 in order to prevent an increase of the viscosity of the ink is referred to as "fine vibration".

Here, all of voltages at start timings of the voltage waveform Adp, the voltage waveform Bdp, and the voltage waveform Cdp and voltages at end timings thereof are commonly a voltage Vc. That is, the voltage waveforms Adp, Bdp, and Cdp are voltage waveforms in which a voltage starts at the voltage Vc and ends at the voltage Vc. Thus, the drive signal generation circuit 50 outputs the drive signal COM having a voltage waveform in which the voltage waveforms Adp, Bdp, and Cdp are consecutive in the cycle Ta.

If the voltage waveform Adp is supplied to the piezoelectric element 60 in the period T1, and the voltage waveform Bdp is supplied to the piezoelectric element 60 in the period T2. Thus, an ink of a median amount and an ink of a small amount are ejected from the ejection unit 600 in the cycle Ta. Accordingly, "a large dot" is formed on the medium P. If the voltage waveform Adp is supplied to the piezoelectric element 60 in the period T1, and the voltage waveform Bdp is not supplied to the piezoelectric element 60 in the period T2, the ink of a median amount is ejected from the ejection unit 600 in the cycle Ta. Accordingly, "a medium dot" is formed on the medium P. If the voltage waveform Adp is not supplied to the piezoelectric element 60 in the period T1, and the voltage waveform Bdp is supplied to the piezoelectric element 60 in the period T2, the ink of a small amount is ejected from the ejection unit 600 in the cycle Ta. Accordingly, "a small dot" is formed on the medium P. If the voltage waveforms Adp and Bdp are not supplied to the piezoelectric element 60 in the periods T1 and T2, and the voltage waveform Cdp is supplied to the piezoelectric element 60 in the period T3, fine vibration is performed without ejecting the ink from the ejection unit 600, in the cycle Ta. In this case, a dot is not formed on the medium P.

Figure 6:
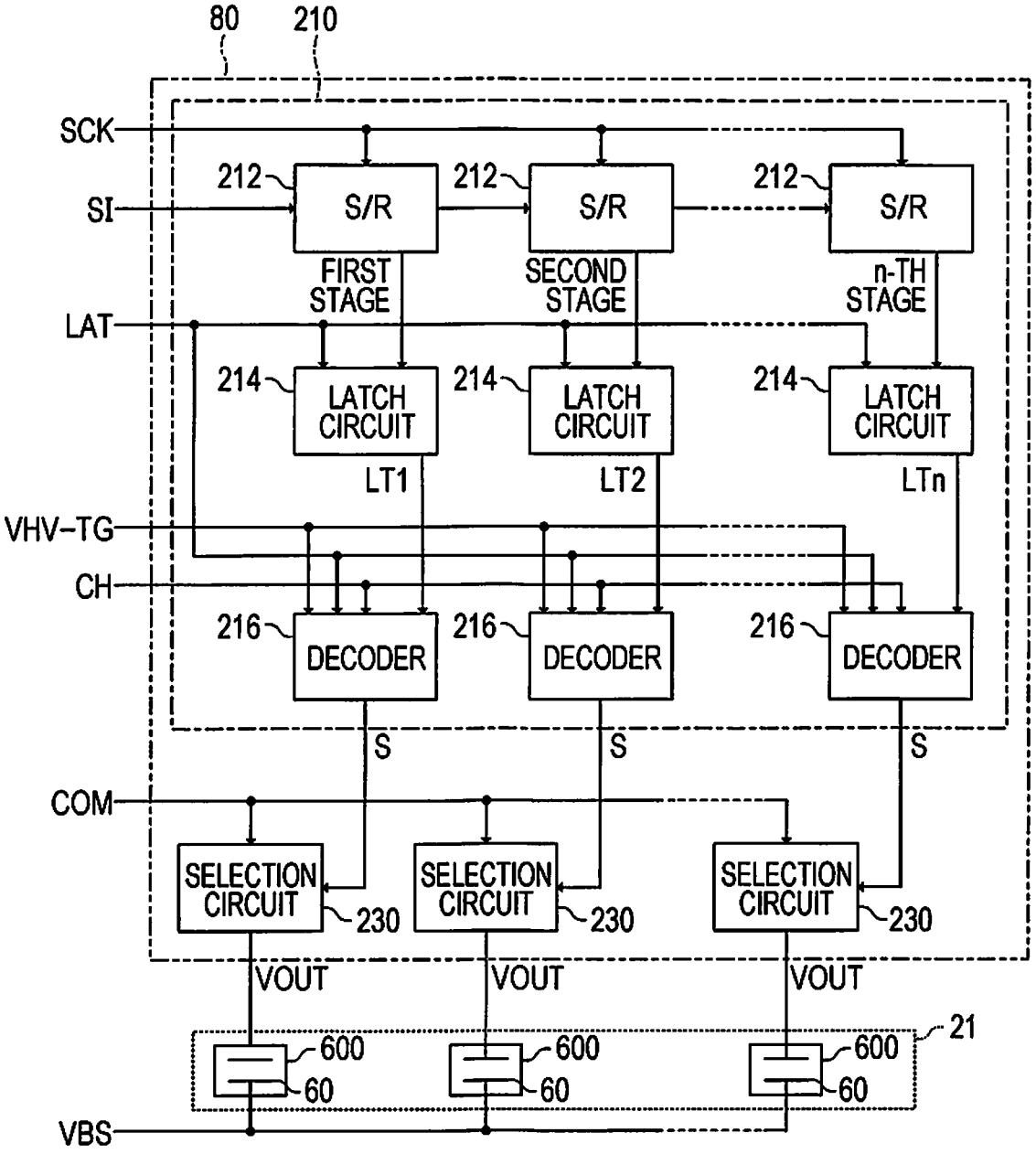
FIG. 6 is a block diagram illustrating an electrical configuration of an ejection module and a drive IC.

FIG. 6 is a block diagram illustrating an electrical configuration of the ejection module 21 and the drive IC 80. As illustrated in FIG. 6, the drive IC 80 includes a selection control circuit 210 and a plurality of selection circuits 230.

The clock signal SCK, the print data signal SI, the latch signal LAT, the change signal CH, and the voltage VHV-TG are supplied to the selection control circuit 210. A set of a shift register (S/R) 212, a latch circuit 214, and a decoder 216 is provided in the selection control circuit 210, so as to correspond to each ejection unit 600. That is, sets of the shift registers 212, the latch circuits 214, and the decoders 216, of which the number is equal to the total number n of the ejection unit 600, are provided in the head unit 20.

The shift register 212 holds two-bit print data [SIH, SIL] included in a print data signal SI, for each corresponding ejection unit 600.

In detail, shift registers 212 of which the stage number corresponds to the ejection unit 600 are continuously connected to each other, and the print data signal SI supplied in serial is sequentially transferred to the subsequent stages in accordance with the clock signal SCK. In FIG. 6, in order to distinguish the shift registers 212 from each other, the shift registers 212 are marked as a first stage, a second stage, . . . , and an n-th stage in order from an upstream side to which the print data signal SI is supplied.

Each of latch circuits 214 of which the number is n latches the print data [SIH, SIL] held in the corresponding shift register 212, at the rising edge of the latch signal LAT.

Each of decoders 216 of which the number is n generates a selection signal S by decoding the two-bit print data [SIH, SIL] latched by the corresponding latch circuit 214, and supplies the generated selection signal S to the selection circuit 230.

The selection circuits 230 are provided to correspond to the ejection units 600, respectively. That is, the number of selection circuits 230 in one head unit 20 is equal to the total number n of the ejection units 600 in the head unit 20. The selection circuit 230 controls a supply of the drive signal COM to the piezoelectric element 60 based on the selection signal S supplied from the decoder 216.

Figures 7, 8:
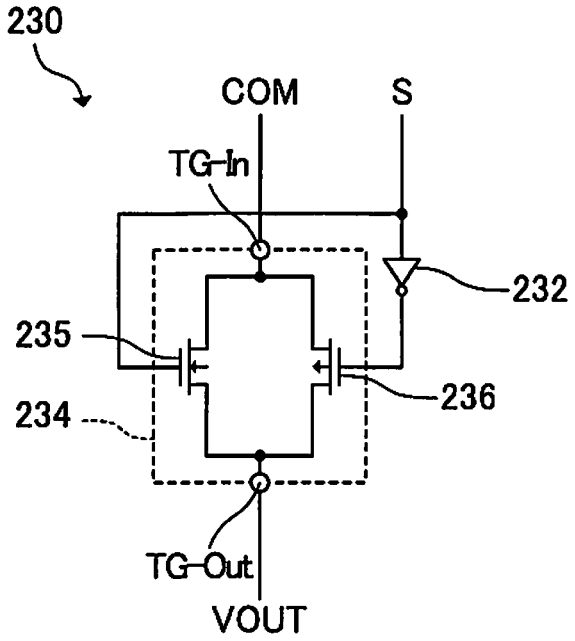
FIG. 7 is a circuit diagram illustrating an electrical configuration of a selection circuit.
FIG. 8 is a diagram illustrating contents of decoding in a decoder.

FIG. 7 is a circuit diagram illustrating an electrical configuration of the selection circuit 230 corresponding to one ejection unit 600.

As illustrated in FIG. 7, the selection circuit 230 includes an inverter (NOT circuit) 232 and a transfer gate 234. The transfer gate 234 includes a transistor 235 which is an NMOS transistor and a transistor 236 which is a PMOS transistor.

The selection signal S is supplied from the decoder 216 to a gate terminal of the transistor 235. The logic of the selection signal S is inverted by the inverter 232, and the signal having the inverted logic is supplied to a gate terminal of the transistor 236.

A drain terminal of the transistor 235 and a source terminal of the transistor 236 are connected to a terminal TG-In. The drive signal COM is supplied to the terminal TG-In. If the transistor 235 and the transistor 236 are controlled to be in the ON or OFF state, in accordance with the selection signal S, the drive signal VOUT is output from a terminal TG-Out which is commonly connected to a source terminal of the transistor 235 and a drain terminal of the transistor 236, and then is supplied to the ejection module 21. The terminal TG-In is an example of "a first terminal". The terminal TG-Out is an example of "a second terminal". The transfer gate 234 is an example of "a switching circuit". In the following descriptions, a case where the transistor 235 and the transistor 236 in the transfer gate 234 are controlled to be in a conductive state is referred to as controlling of the transfer gate 234 to be in the ON state. In addition, a case where the transistor 235 and the transistor 236 are controlled to be in a non-conductive state is referred to as controlling of the transfer gate 234 to be in the OFF state.

Next, contents of decoding of the decoder 216 will be described with reference to FIG. 8. FIG. 8 is a diagram illustrating the contents of decoding in the decoder 216.

The two-bit print data [SIH, SIL], the latch signal LAT, and the change signal CH are input to the decoder 216. The decoder 216 outputs the selection signal S having a logical level based on the print data [SIH, SIL], in each of the periods T1, T2, and T3 defined by the latch signal LAT and the change signal CH.

Specifically, in a case where the print data [SIH, SIL] is [1, 1] for defining "a large dot", the decoder 216 outputs the selection signal S which has an H level in the period T1, an H level in the period T2, and an L level in the period T3.

In a case where the print data [SIH, SIL] is [1, 0] for defining "a medium dot", the decoder 216 outputs the selection signal S which has an H level in the period T1, an L level in the period T2, and an L level in the period T3.

In a case where the print data [SIH, SIL] is [0, 1] for defining "a small dot", the decoder 216 outputs the selection signal S which has an L level in the period T1, an H level in the period T2, and an L level in the period T3.

In a case where the print data [SIH, SIL] is [0, 0] for defining "fine vibration", the decoder 216 outputs the selection signal S which has an L level in the period T1, an L level in the period T2, and an H level in the period T3.

Here, the logical level of the selection signal S is shifted to a high amplitude logic based on the voltage VHV-TG, by a level shifter (not illustrated).

An operation of generating the drive signal VOUT based on the drive signal COM and supplying the generated drive signal VOUT to the ejection unit 600 in the ejection module 21, in the above-described drive IC 80, will be described with reference to FIG. 9.

Figure 9:
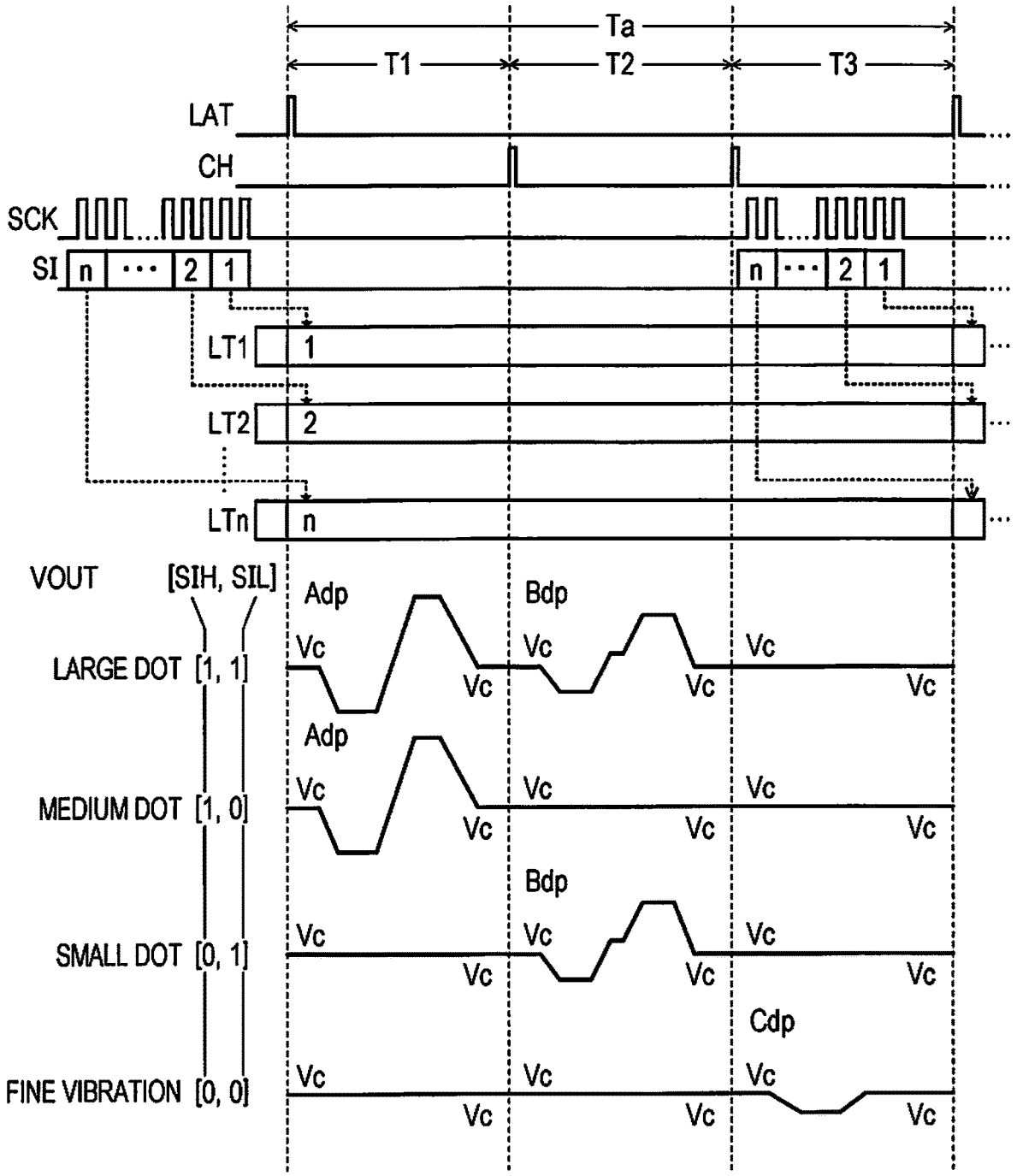
FIG. 9 is a diagram illustrating an operation of the drive IC.

FIG. 9 is a diagram illustrating the operation of the drive IC 80.

The print data signal SI is serially supplied in synchronization with the clock signal SCK and is sequentially transferred in the shift register 212 corresponding to the ejection unit 600. If a supply of the clock signal SCK stops, the print data [SIH, SIL] corresponding to the ejection unit 600 is held in each of the shift registers 212. The print data signal SI is supplied in order corresponding to the ejection units 600 of the final n-th stage, . . . , the second stage, and the first stage in the shift register 212.

Here, if the latch signal LAT rises, each of the latch circuits 214 latches the print data [SIH, SIL] held in the corresponding shift register 212. In FIG. 9, LT1, LT2, . . . , and LTn indicate the print data [SIH, SIL] latched by the latch circuits 214 corresponding to the shift registers 212 of the first stage, the second stage, . . . , and the n-th stage, respectively.

The decoder 216 outputs the selection signal S having a logical level depending on the contents illustrated in FIG. 8, in each of the periods T1, T2, and T3 in accordance with the size of a dot defined by the latched print data [SIH, SIL].

In a case where the print data [SIH, SIL] is [1, 1], the selection circuit 230 selects the voltage waveform Adp in the period T1, selects the voltage waveform Bdp in the period T2, and does not select the voltage waveform Cdp in the period T3, in accordance with the selection signal S. As a result, the drive signal VOUT corresponding to a large dot as illustrated in FIG. 9 is supplied to the ejection unit 600.

In a case where the print data [SIH, SIL] is [1, 0], the selection circuit 230 selects the voltage waveform Adp in the period T1, does not select the voltage waveform Bdp in the period T2, and does not select the voltage waveform Cdp in the period T3, in accordance with the selection signal S. As a result, the drive signal VOUT corresponding to a medium dot as illustrated in FIG. 9 is supplied to the ejection unit 600.

In a case where the print data [SIH, SIL] is [0, 1], the selection circuit 230 does not select the voltage waveform Adp in the period T1, selects the voltage waveform Bdp in the period T2, and does not select the voltage waveform Cdp in the period T3, in accordance with the selection signal S. As a result, the drive signal VOUT corresponding to a small dot as illustrated in FIG. 9 is supplied to the ejection unit 600.

In a case where the print data [SIH, SIL] is [0, 0], the selection circuit 230 does not select the voltage waveform Adp in the period T1, does not select the voltage waveform Bdp in the period T2, and selects the voltage waveform Cdp in the period T3, in accordance with the selection signal S. As a result, the drive signal VOUT corresponding to fine vibration as illustrated in FIG. 9 is supplied to the ejection unit 600.

5. Configuration and Operation of Ejection Unit

Figure 10:
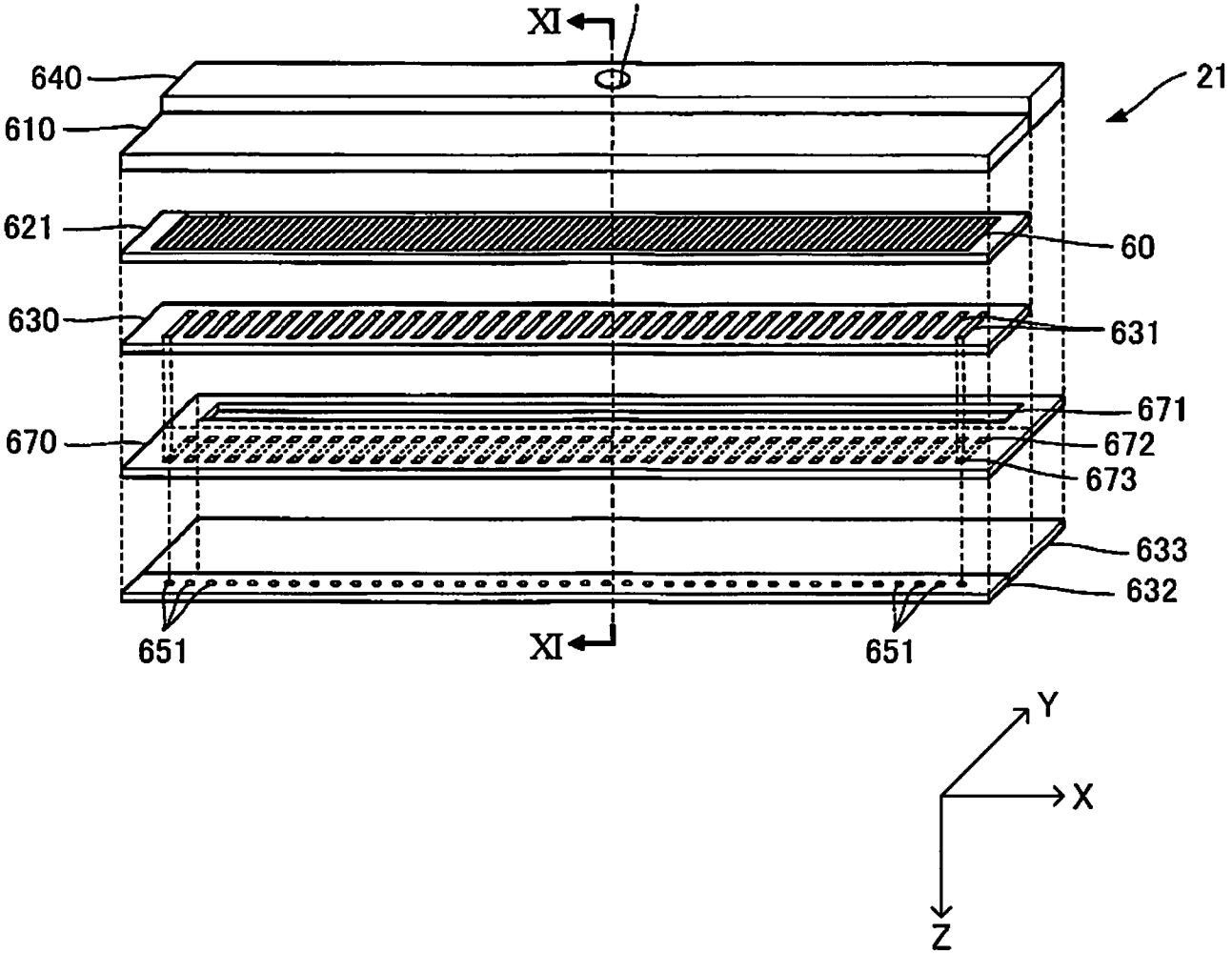
FIG. 10 is an exploded perspective view of the ejection module.
Figure 11:
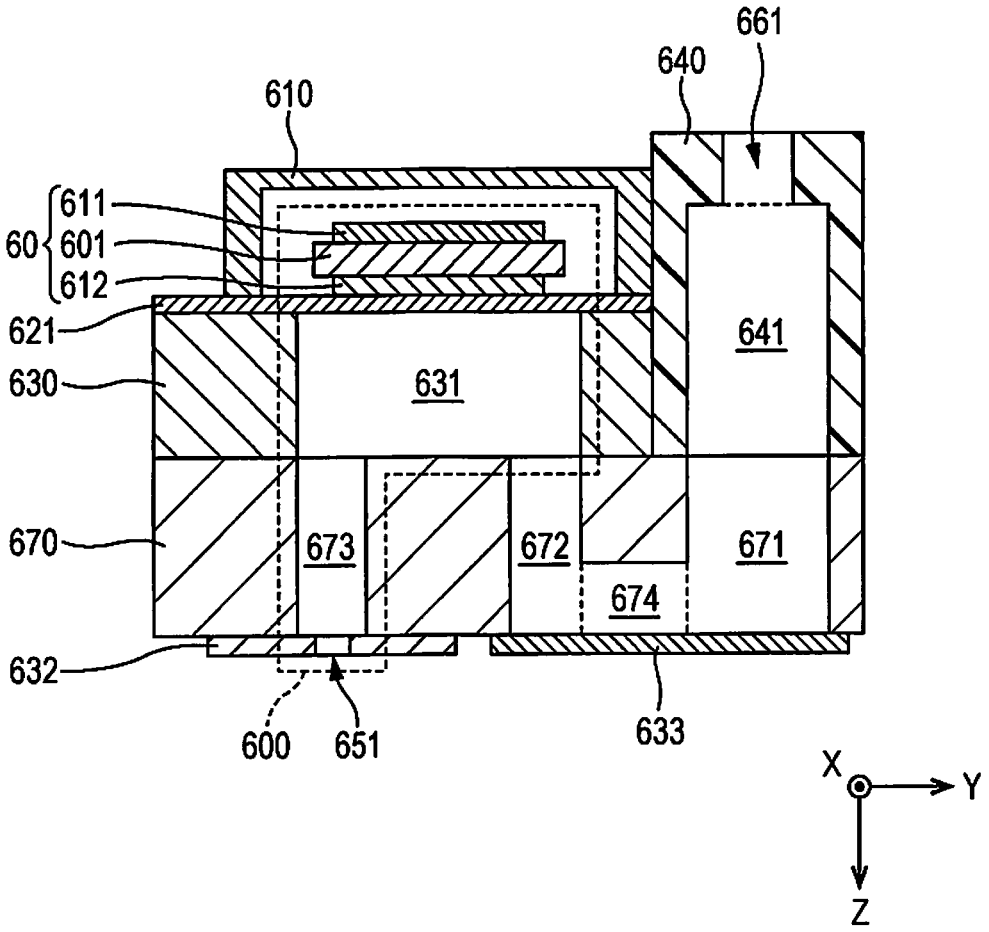
FIG. 11 is a sectional view illustrating an overall configuration of an ejection unit.

Next, a configuration and an operation of the ejection module 21 and the ejection unit 600 will be described. FIG. 10 is an exploded perspective view of the ejection module 21. FIG. 11 is a sectional view taken along line XI-XI in FIG. 10 and is a sectional view illustrating an overall configuration of the ejection unit 600.

As illustrated in FIGS. 10 and 11, the ejection module 21 includes a flow path substrate 670 having a substantially rectangular shape which is long in the direction X. A pressure chamber substrate 630, a vibration plate 621, a plurality of piezoelectric elements 60, a casing member 640, and a sealing member 610 are provided on one surface side of the flow path substrate 670 in the direction Z. A nozzle plate 632 and a vibration absorption member 633 are provided on another surface side of the flow path substrate 670 in the direction Z. Such components of the ejection module 21 are members having a substantially rectangular shape which is long in the direction X, similar to the flow path substrate 670. The components of the ejection module 21 are bonded to each other by using an adhesive or the like.

As illustrated in FIG. 10, the nozzle plate 632 is a plate-shape member in which a plurality of nozzles 651 arranged in the direction X is formed. Such a nozzle 651 is an aperture portion which is provided in the nozzle plate 632 and communicates with a cavity 631 which will be described later.

The flow path substrate 670 is a plate-shape member for forming a flow path of an ink. As illustrated in FIGS. 10 and 11, an opening portion 671, a supply flow path 672, and a communicating flow path 673 are formed in the flow path substrate 670. The opening portion 671 is a through-hole which penetrates in the direction Z, is formed commonly in the plurality of nozzles 651, and is long in the direction X. The supply flow path 672 and the communicating flow path 673 are through-holes formed to correspond to each of the plurality of nozzles 651. As illustrated in FIG. 11, a relay flow path 674 which is formed commonly in a plurality of supply flow paths 672 is provided on one surface of the flow path substrate 670 in the direction Z. The relay flow path 674 communicates with the opening portion 671 and the plurality of supply flow paths 672.

The casing member 640 is a structural body manufactured by injection molding with a resin material, for example. The casing member is fixed to another surface of the flow path substrate 670 in the direction Z. As illustrated in FIG. 11, a supply flow path 641 and a supply port 661 are formed in the casing member 640. The supply flow path 641 is a recess portion corresponding to the opening portion 671 of the flow path substrate 670. The supply port 661 is a through-hole communicating with the supply flow path 641. As described above, a space in which the opening portion 671 of the flow path substrate 670 and the supply flow path 641 of the casing member 640 communicate with each other functions as a reservoir that stores an ink supplied from the supply port 661.

The vibration absorption member 633 is a component to absorb pressure fluctuation occurring in the reservoir. Specifically, the vibration absorption member 633 is fixed to one surface side of the flow path substrate 670 in the direction Z such that the opening portion 671, the relay flow path 674, and the plurality of supply flow paths 672 which have been formed in the flow path substrate 670 are closed, and thereby constitute the bottom surface of the reservoir. Such a vibration absorption member 633 includes, for example, a compliance substrate which is a flexible sheet member capable of elastically deforming.

As illustrated in FIGS. 10 and 11, the pressure chamber substrate 630 is a plate-shape member in which a plurality of cavities 631 corresponding to the plurality of nozzles 651 is formed. The plurality of cavities 631 has a long shape in the direction Y and is provided to be arranged in the direction X. One end portion of the cavity 631 in the direction Y communicates with the supply flow path 672, and the other end portion of the cavity 631 in the direction Y communicates with the communicating flow path 673.

As illustrated in FIGS. 10 and 11, the vibration plate 621 is fixed to a surface of the pressure chamber substrate 630 on an opposite side of the surface thereof which is connected to the flow path substrate 670. The vibration plate 621 is a plate-shape member capable of elastically deforming. Specifically, as illustrated in FIG. 11, the flow path substrate 670 and the vibration plate 621 face each other to be spaced from each other in each of the cavities 631. That is, the vibration plate 621 constitutes an upper surface of the cavity 631, which is a portion of a wall surface of the cavity 631. That is, the cavity 631 is located between the flow path substrate 670 and the vibration plate 621 and functions as a pressure chamber in which pressure is applied to an ink with which the cavity 631 is filled.

As illustrated in FIGS. 10 and 11, the plurality of piezoelectric elements 60 is provided on a surface of the vibration plate 621 on an opposite side of the cavity 631. In other words, the vibration plate 621 is provided between the cavity 631 and the piezoelectric element 60. The plurality of piezoelectric elements 60 is provided to be arranged in the direction X with corresponding to the plurality of cavities 631. The vibration plate 621 vibrates with the piezoelectric element 60 deforming. Thus, pressure in the cavity 631 fluctuates, and an ink is ejected from the nozzle 651. Specifically, the piezoelectric element 60 is an actuator which deforms by supplying the drive signal VOUT. As illustrated in FIG. 11, the piezoelectric element 60 has a structure in which a piezoelectric body 601 is interposed between a pair of electrodes 611 and 612. The drive signal VOUT is supplied to the electrode 611. The criterion voltage signal VBS is supplied to the electrode 612. In this case, in the piezoelectric element 60, the center portion of the piezoelectric body 601 vertically deforms with respect to both end portions, along with the vibration plate 621 in accordance with a potential difference between the electrode 611 and the electrode 612. An ink is ejected from the nozzle 651 by the piezoelectric element 60 deforming. That is, the vibration plate 621 functions as a diaphragm that performs displacement by the piezoelectric element 60, and expands or reduces an internal volume of the cavity 631 filled with the ink. Here, the electrode 611 in the piezoelectric element 60 is an example of a first electrode. The electrode 612 is an example of a second electrode.

The sealing member 610 in FIGS. 10 and 11 is a structural body that protects the plurality of piezoelectric elements 60 and reinforces the mechanical strength of the pressure chamber substrate 630 and the vibration plate 621. The sealing member 610 is fixed to the vibration plate 621 by an adhesive, for example. The plurality of piezoelectric elements 60 is accommodated in a recess portion of the sealing member 610, which is formed on a surface thereof facing the vibration plate 621.

In the ejection module 21 constituted in the above-described manner, a configuration including the piezoelectric element 60, the cavity 631, the vibration plate 621, and the nozzle 651 corresponds to the ejection unit 600.

Figure 12:
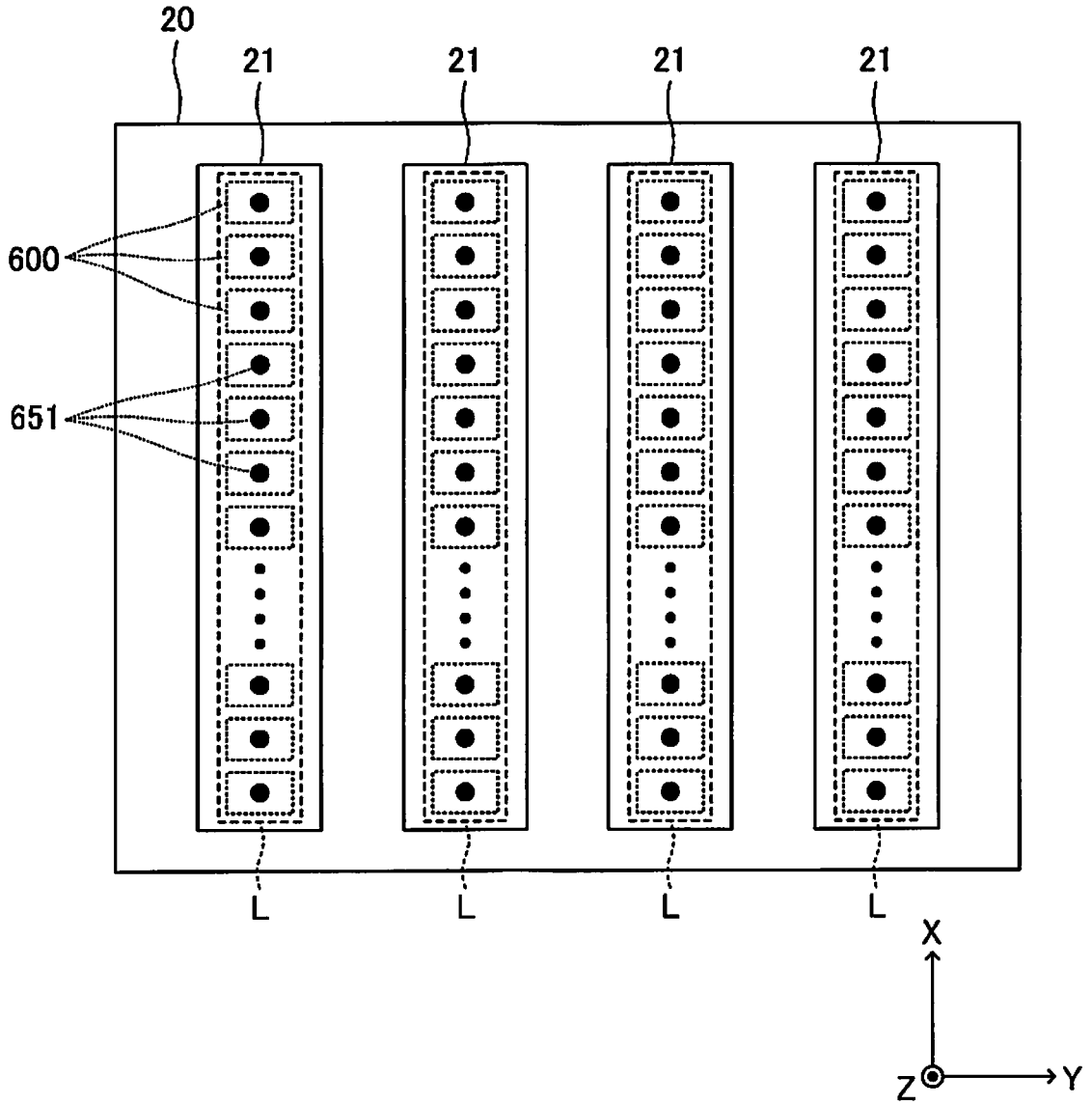
FIG. 12 is a diagram illustrating an example of the ejection module and an arrangement of a plurality of nozzles provided in the ejection module.

FIG. 12 is a diagram illustrating an example of the ejection module 21 and an arrangement of the plurality of nozzles 651 provided in the ejection module 21, in a case where the liquid ejecting apparatus 1 is viewed in the direction Z in a plan view. In FIG. 12, descriptions will be made on the assumption that the head unit 20 includes four ejection modules 21.

As illustrated in FIG. 12, a nozzle row L including a plurality of nozzles 651 provided in a row in a predetermined direction is formed in each of the ejection modules 21. Each nozzle row L is formed by n nozzles 651 arranged in a row in the direction X.

The nozzle row L illustrated in FIG. 12 is just an example and may have a different configuration. For example, in each nozzle row L, n nozzles 651 may be arranged in a staggered manner such that positions of the even-numbered nozzles 651 are different from positions of the odd-numbered nozzles 651 in the direction Y, when counting from the end. Each nozzle row L may be formed in a direction different from the direction X. In the embodiment, the row number of the nozzle rows L provided in each ejection module 21 is set to "1" as an example. However, "2" or more nozzle rows L may be formed in each ejection module 21.

Here, in the embodiment, the n nozzles 651 for forming the nozzle row L are provided at high density, that is, 300 pieces or more per 1 inch in the ejection module 21. Therefore, in the ejection module 21, n piezoelectric elements 60 are provided at high density so as to correspond to the n nozzles 651.

In the embodiment, the piezoelectric body 601 used in the piezoelectric element 60 is preferably a thin film having a thickness which is equal to or smaller than 1 μm, for example. Thus, it is possible to increase an amount of displacement of the piezoelectric element 60 with respect to the potential difference between the electrode 611 and the electrode 612.

Figure 13:
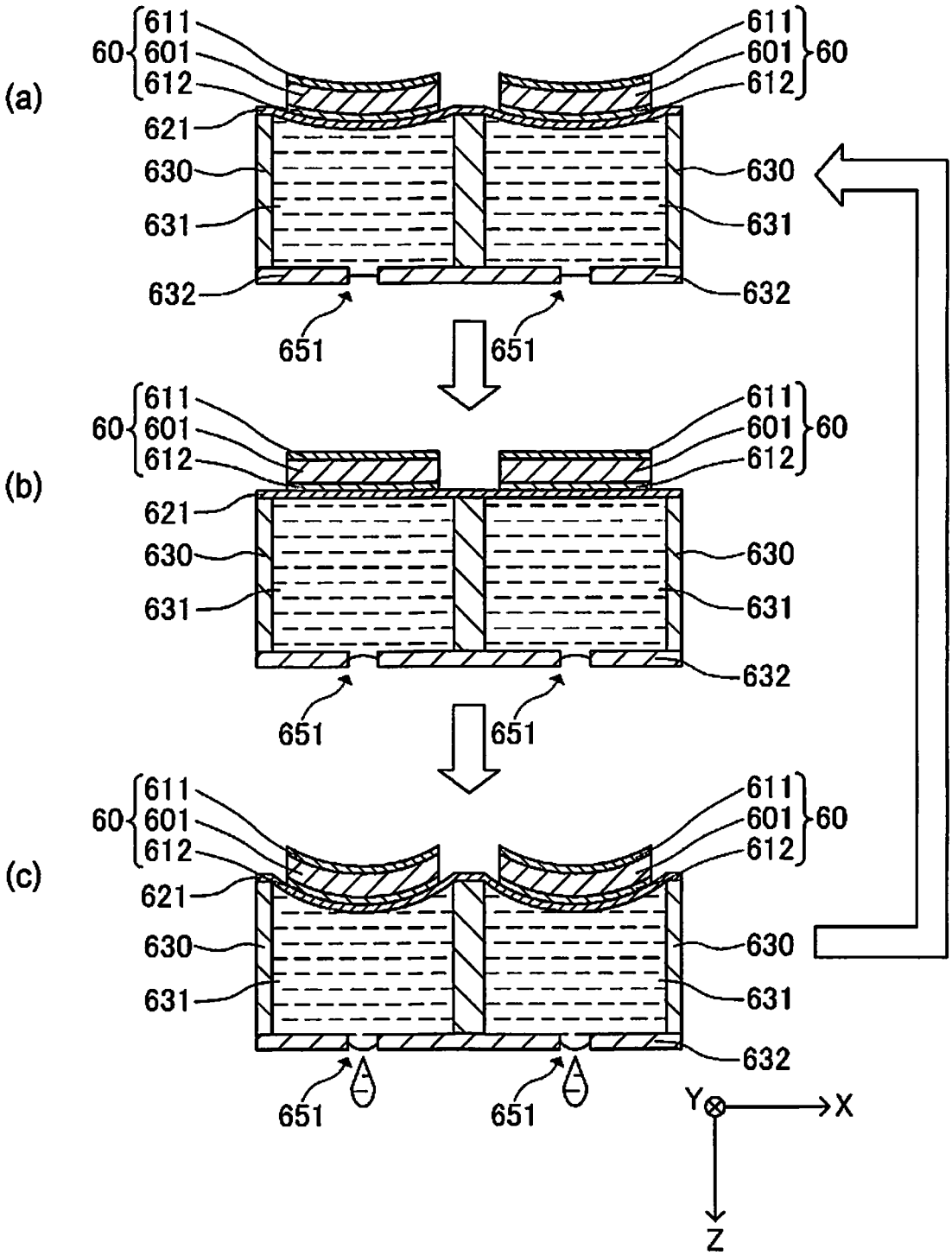
FIG. 13 is a diagram illustrating a relationship between displacement of a piezoelectric element and a vibration plate and an ejection.

Here, an ejection operation of an ink ejected from the nozzle 651 will be described with reference to FIG. 13. FIG. 13 is a diagram illustrating a relationship between displacement of the piezoelectric element 60 and the vibration plate 621 and an ejection, in a case where the drive signal VOUT is supplied to the piezoelectric element 60. (a) of FIG. 13 schematically illustrates the displacement of the piezoelectric element 60 and the vibration plate 621 in a case where the voltage Vc as the drive signal VOUT is supplied. (b) of FIG. 13 schematically illustrates the displacement of the piezoelectric element 60 and the vibration plate 621 in a case where the voltage of the drive signal VOUT supplied to the piezoelectric element 60 is controlled to approach the criterion voltage signal VBS from the voltage Vc. (c) of FIG. 13 schematically illustrates the displacement of the piezoelectric element 60 and the vibration plate 621 in a case where the voltage of the drive signal VOUT supplied to the piezoelectric element 60 is controlled to be separated from the criterion voltage signal VBS farther than the voltage Vc.

In a state of (a) of FIG. 13, the piezoelectric element 60 and the vibration plate 621 bend in the direction Z in accordance with a potential difference between the drive signal VOUT supplied to the electrode 611 and the criterion voltage signal VBS supplied to the electrode 612. At this time, the voltage Vc is supplied to the electrode 611 as the drive signal VOUT. As described above, the voltage Vc is a voltage at the start timings and the end timings of the voltage waveforms Adp, Bdp, and Cdp.

In a case where the voltage of the drive signal VOUT is controlled to approach the voltage of the criterion voltage signal VBS, as illustrated in (b) of FIG. 13, the amount of displacement of the piezoelectric element 60 and the vibration plate 621 in the direction Z is reduced. At this time, the internal volume of the cavity 631 expands, and thereby the ink is attracted into the cavity 631.

Then, the voltage of the drive signal VOUT is controlled to be separated from the voltage of the criterion voltage signal VBS. At this time, as illustrated in (c) of FIG. 13, the amount of displacement of the piezoelectric element 60 and the vibration plate 621 in the direction Z increases. At this time, the internal volume of the cavity 631 is reduced, and thus the ink with which the cavity 631 is filled is ejected from the nozzle 651.

In the embodiment, the states of (a) to (c) of FIG. 13 repeat by supplying the drive signal VOUT to the piezoelectric element 60. Thus, the ink is ejected from the nozzle 651, and a dot is formed on the medium P. The amount of displacement of the piezoelectric element 60 and the vibration plate 621 illustrated in (a) to (c) of FIG. 13 increases in the direction Z, as the potential difference between the drive signal VOUT supplied to the electrode 611 and the criterion voltage signal VBS supplied to the electrode 612 increases. In other words, the amount of the ink ejected from the nozzle 651 is controlled in accordance with the potential difference between the drive signal VOUT and the criterion voltage signal VBS.

The displacement of the piezoelectric element 60 and the vibration plate 621 with respect to the drive signal VOUT as illustrated in FIG. 13 is just an example. For example, in a case where the potential difference between the drive signal VOUT and the criterion voltage signal VBS is large, the ink may be attracted into the cavity 631. In addition, in a case where the potential difference between the drive signal VOUT and the criterion voltage signal VBS is small, the ink with which the cavity 631 is filled may be ejected from the nozzle 651.

6. Influence of Voltage Fluctuation of Criterion Voltage Signal VBS

As described above, the piezoelectric element 60 performs displacement by the potential difference between the electrodes 611 and 612, so as to eject an ink. However, in a case where a not-intended voltage is supplied to any of the electrode 611 and the electrode 612, the piezoelectric element 60 performs not-intended displacement. Therefore, not-intended stress may occur in the piezoelectric element 60 and the vibration plate 621.

Figure 14:
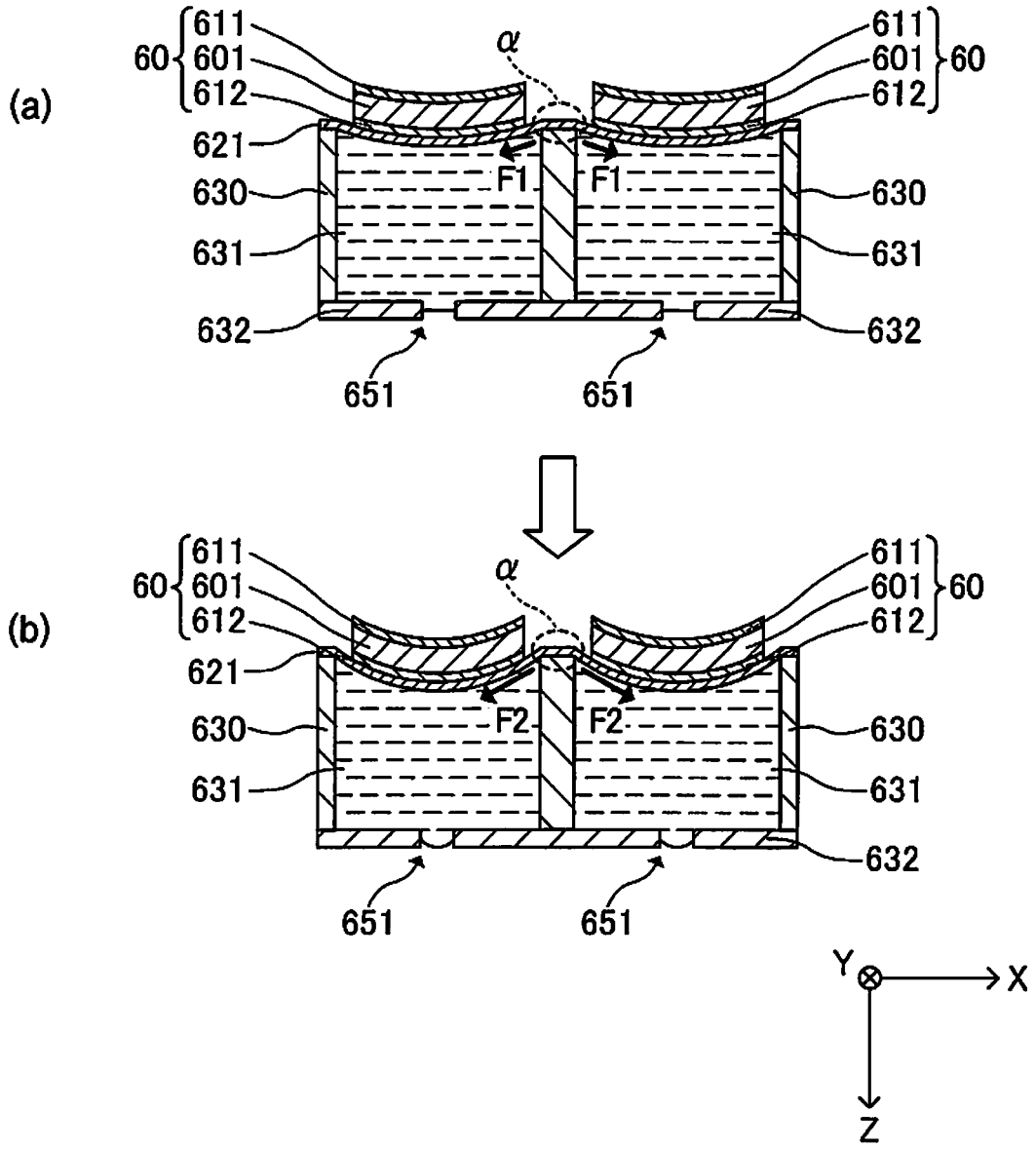
FIG. 14 is a diagram illustrating the displacement of the piezoelectric element and the vibration plate and stress occurring in the vibration plate, in a case where a voltage value of an electrode in the piezoelectric element rises.

FIG. 14 is a diagram illustrating displacement of the piezoelectric element 60 and the vibration plate 621 and stress occurring in the vibration plate 621, in a case where the voltage value of the electrode in the piezoelectric element 60 rises. FIG. 14 is a sectional view in a case where the plurality of piezoelectric elements 60, the cavity 631, and two nozzles 651 in the ejection module 21 are viewed from the direction Y. (a) of FIG. 14 illustrates displacement of the piezoelectric element 60 and the vibration plate 621 in a case where a predetermined voltage is supplied to both the electrodes 611 and 612. (b) of FIG. 14 illustrates displacement of the piezoelectric element 60 and the vibration plate 621 in a case where a not-intended voltage is supplied to any of the electrode 611 and the electrode 612.

As illustrated in (a) of FIG. 14, in a case where the predetermined voltage is supplied to both the electrodes 611 and 612, a potential difference in an assumed range occurs between the electrode 611 and the electrode 612. Thus, the piezoelectric element 60 performs displacement in an assumed range. Similarly, the vibration plate 621 performs displacement in an assumed range. At this time, stress F1 in an assumed range occurs at a contact point a between the vibration plate 621 and the cavity 631.

As illustrated in (b) of FIG. 14, in a case where a not-intended voltage is supplied to either the electrode 611 or the electrode 612, a potential difference out of the assumed range may occur between the electrode 611 and the electrode 612. Thus, the piezoelectric element 60 performs displacement out of the assumed range. Similarly, the vibration plate 621 also performs displacement out of the assumed range. At this time, stress F2 larger than assumed may intensively occur at the contact point a between the vibration plate 621 and the cavity 631.

Stress occurring at the contact point between the vibration plate 621 and the cavity 631 may vary depending on the position of the contact point between the vibration plate 621 and the cavity 631. Specifically, regarding the stress occurring at the contact point between the vibration plate 621 and the cavity 631 in the direction Y, larger stress occurs at a point which is the contact point between the vibration plate 621 and the cavity 631 and at which the vibration plate 621 performs the maximum displacement in the direction Z.

Figure 15:
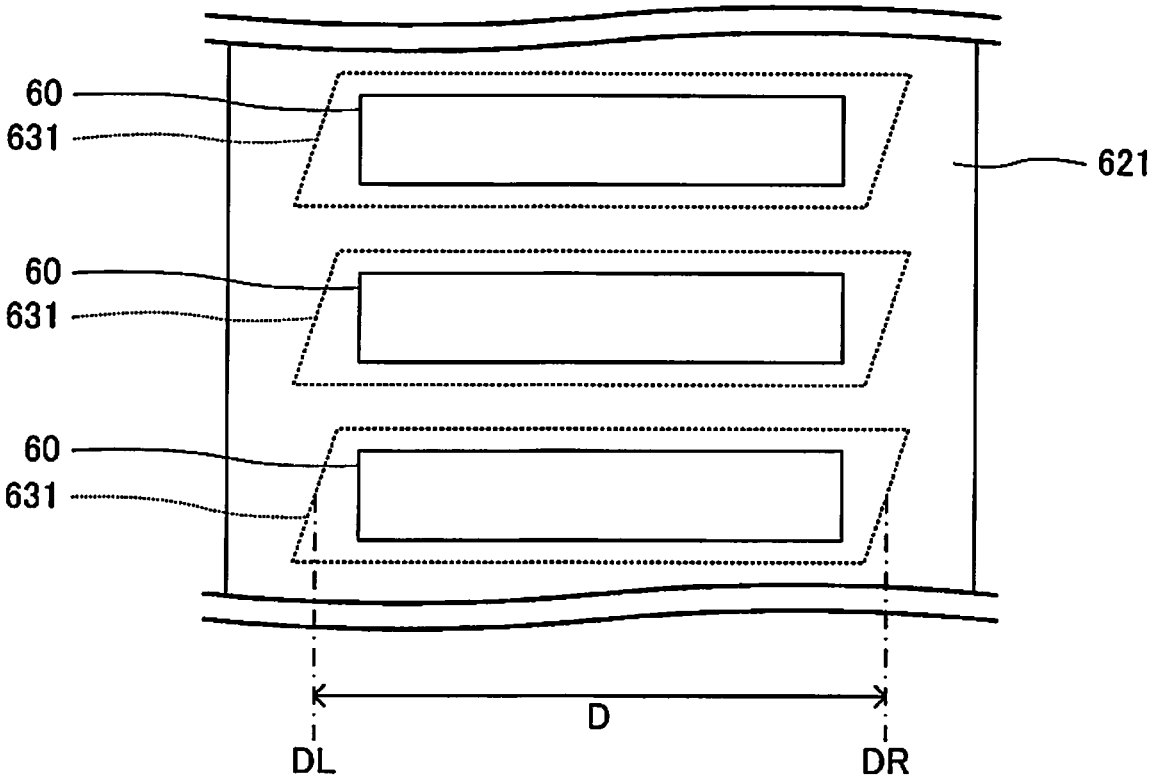
FIG. 15 is a plan view in a case where the vibration plate is viewed from a direction Z.

Examples of a factor of such displacement of the vibration plate 621 include a natural vibration occurring in the vibration plate 621. FIG. 15 is a plan view in a case where the vibration plate 621 is viewed from the direction Z. As illustrated in FIG. 15, the cavity 631 in the embodiment is long in the direction Y, and thus a natural vibration along the direction Y may occur in the vibration plate 621. Such a natural vibration occurs in a vibration region D between a first contact point DL and a second contact point DR at which the vibration plate 621 and the cavity 631 are in contact with each other.

Figure 16:
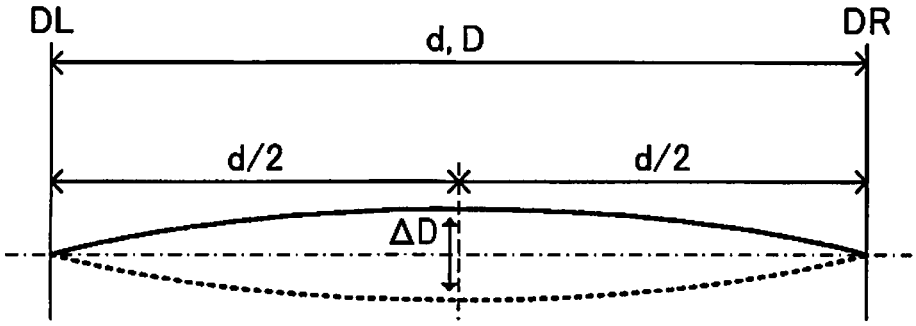
FIG. 16 is a diagram illustrating a case where the vibration plate performs a primary natural vibration.

FIG. 16 is a diagram illustrating a case where a primary natural vibration occurs in the vibration plate 621, as an example. As illustrated in FIG. 16, in a case where the primary natural vibration occurs in the vibration plate 621, displacement ΔD of the vibration plate 621, which is caused by the natural vibration becomes the maximum at the center portion of the vibration region D. Specifically, in a case where a distance from the first contact point DL to the second contact point DR in the vibration region D is set as d, the displacement ΔD of the vibration plate 621 becomes the maximum at a point at which a distance from the first contact point DL is d/2, and a distance from the second contact point DR is d/2.

Figure 17:
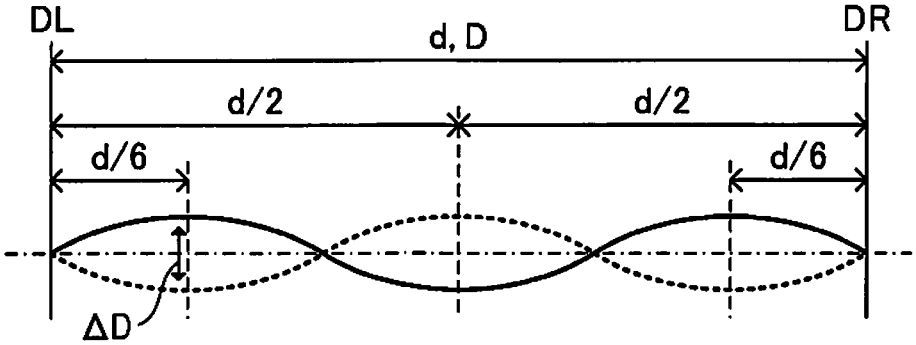
FIG. 17 is a diagram illustrating a case where the vibration plate performs a tertiary natural vibration.

FIG. 17 is a diagram illustrating a case where a tertiary natural vibration occurs in the vibration plate 621, as an example. As illustrated in FIG. 17, in a case where a tertiary natural vibration occurs in the vibration plate 621, the displacement ΔD of the vibration plate 621, which is caused by the natural vibration becomes the maximum at a point at which the distance from the first contact point DL is d/2, and the distance from the second contact point DR is d/2 and at a point at which the distance from the first contact point DL is d/6, and a distance from the second contact point DR is d/6.

As described above, larger stress F2 may be applied to the contact point a between the vibration plate 621 and the cavity 631 among the points at which the displacement ΔD of the vibration plate 621 is the maximum, in the direction Y.

In a case where stress F2 larger than assumed concentrates on the contact point a between the vibration plate 621 and the cavity 631, cracks may occur in the vibration plate 621. In a case where the drive signal COM is applied to the electrode 611 in a state where the vibration plate 621 performs displacement larger than assumed, a load larger than necessary may be applied to the vibration plate 621 by the displacement of the piezoelectric element 60. As a result, cracks may occur in the vibration plate 621.

If the cracks occur in the vibration plate 621, the ink with which the cavity 631 is filled is leaked from the cracks. Therefore, the amount of the ejected ink with respect to the change of the internal volume of the cavity 631 may vary. As a result, ejection accuracy of the ink is deteriorated.

In particular, the criterion voltage signal VBS supplied to the electrode 612 is commonly supplied to the plurality of piezoelectric elements 60 provided in the ejection module 21. Thus, in a case where the criterion voltage signal VBS has a not-intended voltage, the not-intended voltage influences displacement of the plurality of piezoelectric elements 60 and the vibration plate 621. As a result, cracks may occur in a plurality of vibration plates 621, and may influence ejection accuracy of the entirety of the liquid ejecting apparatus 1.

In a case where the voltage of the criterion voltage signal VBS supplied to the electrode 612 and thus becomes higher than the voltage of the drive signal VOUT supplied to the electrode 611, the function of the piezoelectric element 60 may be impaired.

The piezoelectric body 601 of the piezoelectric element 60 has a difficulty in being formed as a single crystal. Thus, the piezoelectric body 601 is formed as a polycrystal which is an aggregate of microcrystals of a ferroelectric substance. At time of manufacturing, since a direction of spontaneous polarization of each microcrystal is spontaneously oriented in disjointed directions, piezoelectric characteristics of the piezoelectric body 601 are not shown. Thus, before the piezoelectric element 60 is assembled in the head unit 20, a predetermined DC electric field is applied to the piezoelectric body 601 so as to perform polarization processing (poling) of aligning polarization directions. With the polarization processing, the piezoelectric characteristics of the piezoelectric body 601 are shown.

In the embodiment, in a case where a potential of the electrode 611 in the piezoelectric element 60 is higher than a potential of the electrode 612, an electric field having the same polarity as that at the time of the polarization processing of the piezoelectric body 601 is applied to the piezoelectric element 60. In a case where the potential of the electrode 611 in the piezoelectric element 60 is higher than the potential of the electrode 612, an electric field having a polarity (referred to as "a reverse polarity electric field" below) which is reverse to that at the time of the polarization processing of the piezoelectric body 601 is applied to the piezoelectric element 60.

If a reverse polarity electric field is applied to the piezoelectric element 60, the polarization direction aligned by the polarization processing, in the piezoelectric body 601, is disturbed. Such disturbance of the polarization direction deteriorates the piezoelectric characteristics, and thus operation failure of the piezoelectric element 60 may be caused.

The piezoelectric body 601 is a polycrystal. Thus, stress partially concentrates in a manufacturing process or in the middle of the polarization processing. Thus, the piezoelectric body 601 has latent micro-cracks. The application of the reverse polarity electric field to the piezoelectric element 60 not only disturbs the polarization direction of the piezoelectric body 601, but also causes micro-cracks to grow by a change manner of the polarization direction differing for each microcrystal. Thus, breaking the piezoelectric body 601 may be caused. In particular, in the piezoelectric body 601 which is a thin film of 1 μm or smaller as described in the embodiment, the growing cracks easily penetrate in a thickness direction. If the cracks penetrate in the thickness direction, an electrical short circuit may occur between the electrode 611 and the electrode 612, and thus the function of the piezoelectric element 60 may be impaired.

7. Configuration and Operation of Criterion Voltage Generation Circuit

As described above, in a case where the voltage of the criterion voltage signal VBS fluctuates, the piezoelectric element 60 may perform not-intended displacement, and the ejection accuracy may be deteriorated. Further, with the fluctuation of the voltage, the function of the piezoelectric element 60 may be impaired.

In the embodiment, in the criterion voltage circuit 450 that generates the criterion voltage signal VBS, a configuration for improving accuracy of the criterion voltage signal VBS and a configuration for protecting the liquid ejecting apparatus 1 in a case where the voltage of the criterion voltage signal VBS is abnormal are provided.

Figure 18:
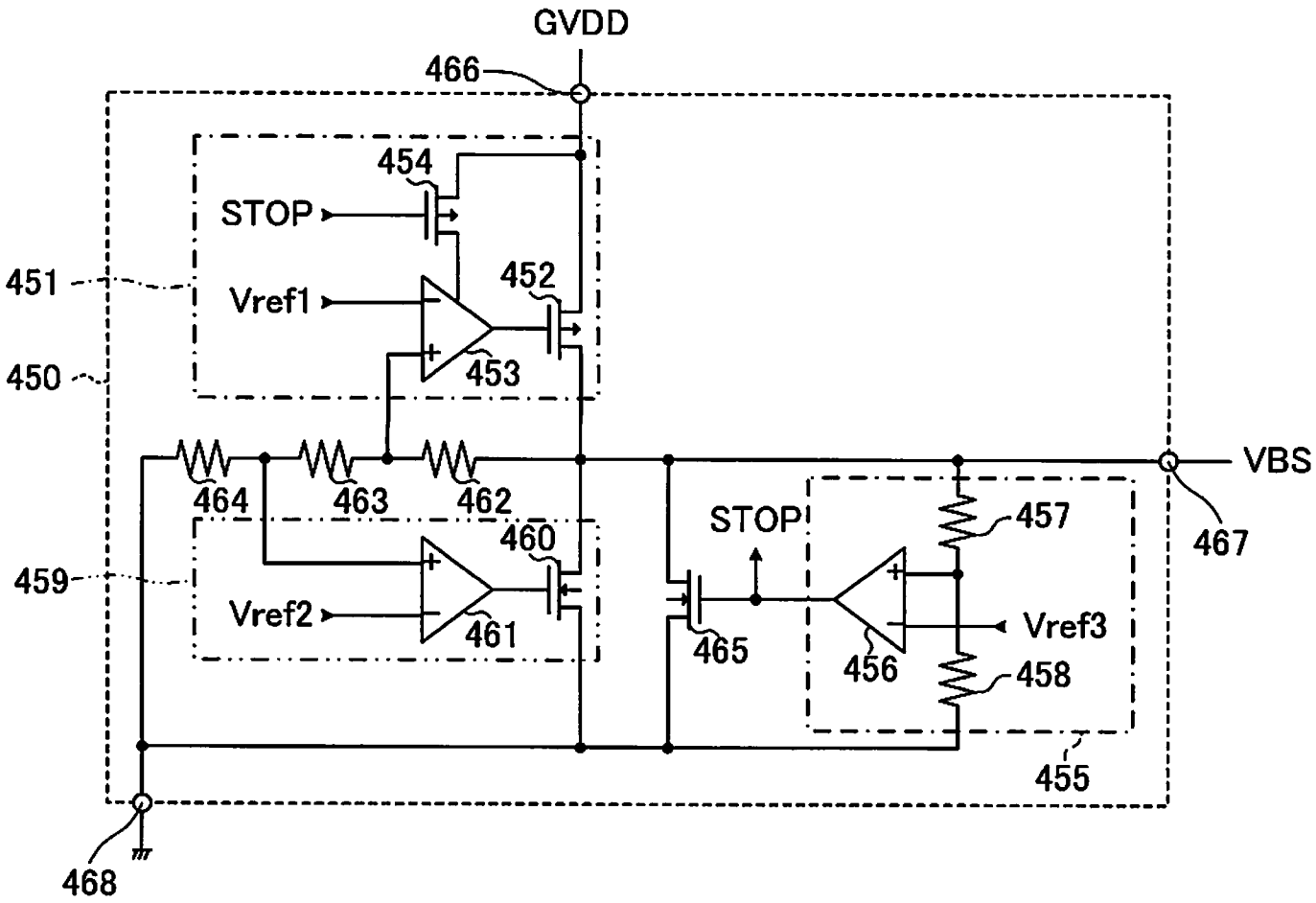
FIG. 18 is a circuit diagram illustrating an electrical configuration of a criterion voltage circuit.

FIG. 18 is a circuit diagram illustrating an electrical configuration of the criterion voltage circuit 450.

The criterion voltage circuit 450 includes a voltage generation unit 451, a voltage detection unit 455, a clamp circuit 459, resistors 462, 463, and 464, and a transistor 465. The criterion voltage circuit 450 includes a terminal 466 to which the voltage GVDD as the power-supply voltage is supplied, a terminal 467 from which the criterion voltage signal VBS is output, and a terminal 468 connected to the ground potential. That is, the terminal 466 is an example of "a power supply terminal". The terminal 467 is an example of "a criterion voltage-signal output terminal". The terminal 468 is an example of "a ground terminal".

One end of the resistor 462 is connected to the terminal 467. The other end of the resistor 462 is connected to one end of the resistor 463. The other end of the resistor 463 is connected to one end of the resistor 464. The other end of the resistor 464 is connected to the terminal 468. That is, the resistors 462, 463, and 464 are connected in series, between the terminal 467 and the terminal 468.

The voltage generation unit 451 includes transistors 452 and 454 and a comparator 453. In the following descriptions, descriptions will be made on the assumption that the transistors 452 and 454 are PMOS transistors.

An input end (+) of the comparator 453 is connected to the other end of the resistor 462 and the one end of the resistor 463. A first reference voltage Vref1 is supplied to an input end (−) of the comparator 453. An output end of the comparator 453 is connected to a gate terminal of the transistor 452.

A source terminal of the transistor 452 is connected to the terminal 466. A drain terminal of the transistor 452 is connected to the terminal 467.

The control signal STOP output by the voltage detection unit 455 described later is supplied to a gate terminal of the transistor 454. A source terminal of the transistor 454 is connected to the terminal 466. A drain terminal of the transistor 454 is connected to a power supply terminal (not illustrated) of the comparator 453.

The clamp circuit 459 includes a comparator 461 and a transistor 460.

An input end (+) of the comparator 461 is connected to the other end of the resistor 463 and the one end of the resistor 464. A second reference voltage Vref2 is supplied to an input end (−) of the comparator 461. An output end of the comparator 461 is connected to a gate terminal of the transistor 460.

A drain terminal as an example of one end of the transistor 460 is connected to the terminal 467. A source terminal as an example of the other end of the transistor 460 is connected to the terminal 468. The transistor 460 is an example of "a first discharge transistor".

The voltage detection unit 455 includes resistors 457 and 458 and a comparator 456.

One end of the resistor 457 is connected to the terminal 467. The other end of the resistor 457 is connected to one end of the resistor 458. The other end of the resistor 458 is connected to the terminal 468. That is, the resistors 457 and 458 are connected in series, between the terminal 467 and the terminal 468.

An input end (+) of the comparator 456 is connected to the other end of the resistor 457 and the one end of the resistor 458. A third reference voltage Vref3 is supplied to an input end (−) of the comparator 456. An output end of the comparator 456 is connected to a gate terminal of the transistor 465.

Descriptions will be made below on the assumption that the transistor 465 is an NMOS transistor. The control signal STOP is supplied to the gate terminal of the transistor 465. A drain terminal as an example of one end of the transistor 465 is connected to the terminal 467. A source terminal as an example of the other end of the transistor 465 is connected to the terminal 468. The transistor 465 is an example of "a second discharge transistor".

An operation of the criterion voltage circuit 450 constituted in the above-described manner will be described with reference to FIGS. 19 to 21.

Figure 19:
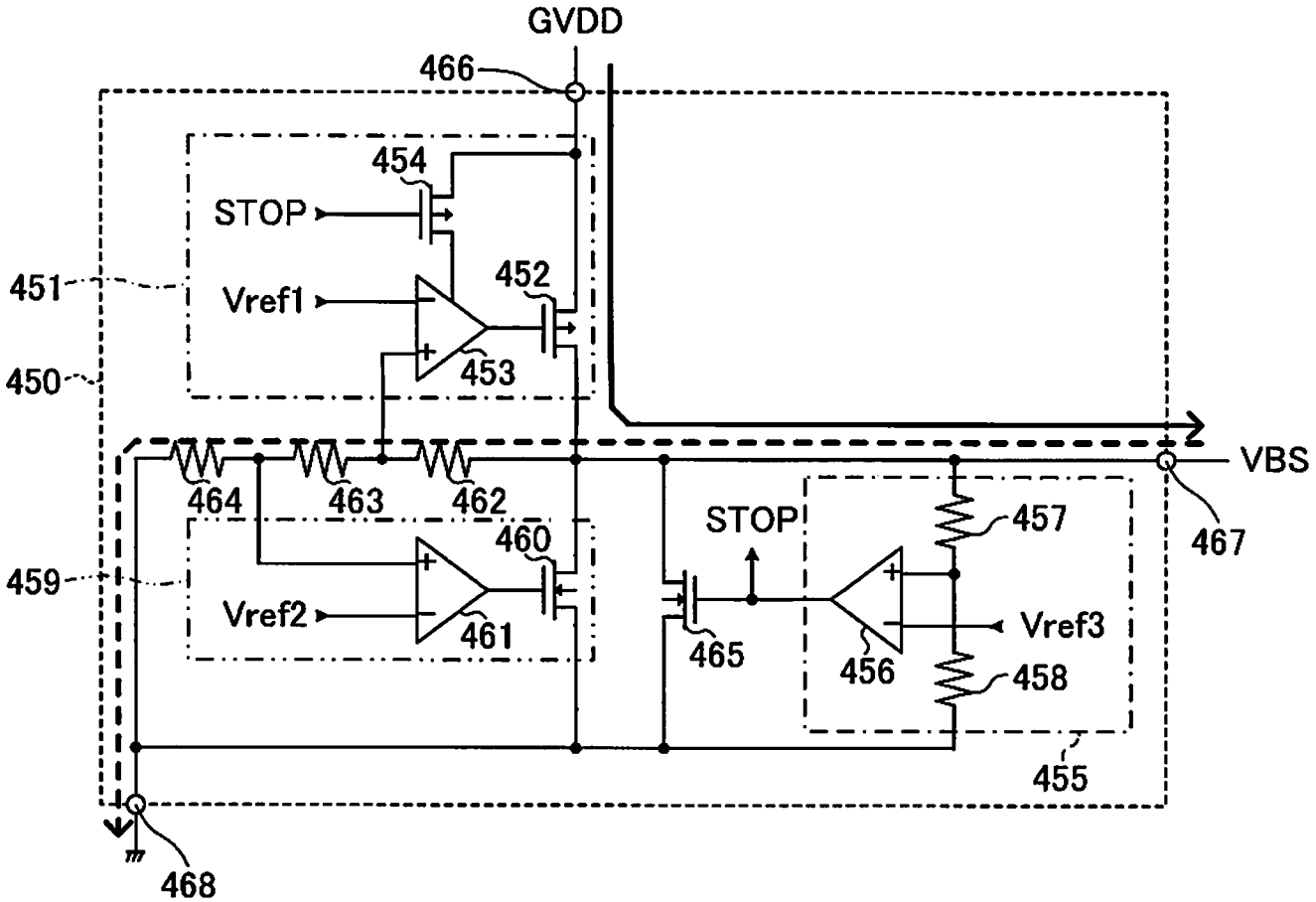
FIG. 19 is a diagram illustrating an operation in a case where a criterion voltage signal having a predetermined voltage is generated.

FIG. 19 is a diagram illustrating an operation where the criterion voltage signal VBS having a predetermined voltage is generated in the criterion voltage circuit 450.

As illustrated in FIG. 19, a voltage obtained by dividing the criterion voltage signal VBS by the resistor 462 and a combined resistor of the resistor 463 and the resistor 464 is supplied to an input end (+) of the comparator 453. The first reference voltage Vref1 is supplied to an input end (−) thereof. Specifically, in a case where the voltage of the criterion voltage signal VBS has a predetermined value, the resistance value of each of the resistors 462, 463, and 464 and the voltage of the first reference voltage Vref1 are determined such that the voltage supplied to the input end (+) of the comparator 453 is equal to the first reference voltage supplied to the input end (−).

In a case where the voltage of the criterion voltage signal VBS is lower than a predetermined value, the voltage supplied to the input end (+) of the comparator 453 is lower than the first reference voltage Vref1. At this time, the comparator 453 outputs a signal having an L level. Thus, the transistor 452 is controlled to be in the ON state. Accordingly, with a path indicated by an arrow of a solid line in FIG. 19, a current is supplied to the terminal 467. Charges are accumulated in the terminal 467, and thus the voltage of the criterion voltage signal VBS rises.

In a case where the voltage of the criterion voltage signal VBS is higher than the predetermined value, the voltage supplied to the input end (+) of the comparator 453 is higher than the first reference voltage Vref1. At this time, the comparator 453 outputs a signal having an H level. Thus, the transistor 452 is controlled to be in the OFF state. Accordingly, with a path indicated by an arrow of a broken line in FIG. 19, the charges accumulated in the terminal 467 are released, and thus the voltage of the criterion voltage signal VBS falls.

As described above, the voltage generation unit 451 compares the first reference voltage Vref1 and a voltage based on the criterion voltage signal VBS to each other in the comparator 453. The transistor 452 turns into the ON or OFF state in accordance with a comparison result, and thereby the criterion voltage signal VBS having a predetermined voltage is generated. That is, the comparator 453 compares the first reference voltage Vref1 and the signal based on the criterion voltage signal VBS to each other, and is an example of "a first comparator". The transistor 452 performs switching of whether or not the terminal 466 and the terminal 467 are electrically connected to each other, based on the comparison result of the comparator 453 and is an example of "a first transistor".

However, the voltage of the criterion voltage signal VBS generated by the voltage generation unit 451 may rise to be higher than a predetermined value, in accordance with a change of the surrounding environment such as the temperature of the liquid ejecting apparatus 1 or a state of a load to which the criterion voltage signal VBS is supplied. In this case, it may not be possible that charges accumulated in the terminal 467 are sufficiently released to the terminal 468 via the resistors 462, 463, and 464.

In a case where the voltage of the criterion voltage signal VBS has risen, the criterion voltage circuit 450 in the embodiment includes the clamp circuit 459 that releases charges accumulated in the terminal 467.

Figure 20:
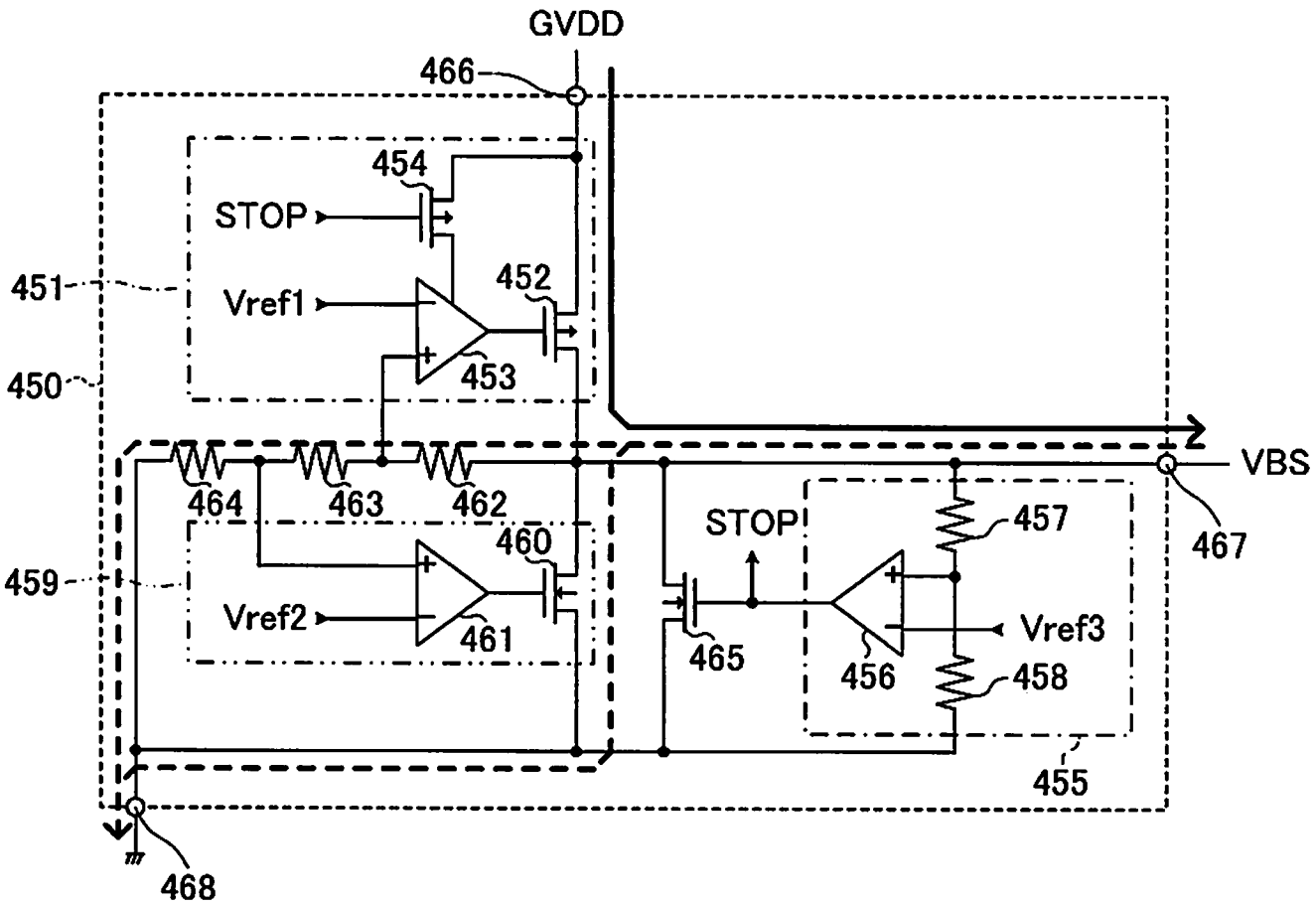
FIG. 20 is a diagram illustrating an operation in a case where the voltage value is controlled in a case where a voltage of the criterion voltage signal has risen.

FIG. 20 is a diagram illustrating an operation in a case where a voltage value is controlled in a case where the voltage of the criterion voltage signal VBS has risen in the criterion voltage circuit 450.

As illustrated in FIG. 20, a voltage obtained by dividing the criterion voltage signal VBS by the resistor 464 and a combined resistor of the resistor 462 and the resistor 463 is supplied to an input end (+) of the comparator 461. The second reference voltage Vref2 is supplied to an input end (−) thereof. Specifically, in a case where the voltage of the criterion voltage signal VBS is higher than a predetermined value by about 1 V, the resistance value of each of the resistors 462, 463, and 464 and the voltage of the second reference voltage Vref2 are determined such that the voltage supplied to the input end (+) of the comparator 461 is equal to the second reference voltage supplied to the input end (−). "The case where the voltage of the criterion voltage signal VBS is higher than the predetermined value by about 1 V" is an example. The voltage may be a voltage as low as does not influence displacement and characteristics of the piezoelectric element 60 in a case where the criterion voltage signal VBS having such a voltage is supplied to the electrode 612.

In a case where the voltage of the criterion voltage signal VBS rises, and the voltage supplied to the input end (+) of the comparator 461 is higher than the second reference voltage Vref2, the comparator 461 outputs a signal having an H level. Thus, the transistor 460 is controlled to be in the ON state. In this case, as indicated by a broken line in FIG. 20, the charges in the terminal 467 are released on a path via the transistor 460 in addition to a path via the resistors 462, 463, and 464.

Accordingly, even in a case where the voltage of the criterion voltage signal VBS may fluctuate by, for example, a change of the surrounding environment such as the temperature of the liquid ejecting apparatus 1 or a change of a state of a load to which the criterion voltage signal VBS is supplied, it is possible to reduce a concern of the voltage of the criterion voltage signal VBS fluctuating.

That is, the comparator 461 compares the second reference voltage Vref2 and the signal based on the criterion voltage signal VBS to each other and is an example of "a second comparator". The transistor 465 performs switching of whether or not the terminal 467 and the terminal 468 are electrically connected to each other, based on a comparison result of the comparator 461 and is an example of "a second transistor".

A portion of the ink ejected in the liquid ejecting apparatus 1 floats in the liquid ejecting apparatus 1. In a case where the floating ink adheres to the criterion voltage circuit 450 or the vicinity thereof, the terminal 467 and a different wiring pattern may have a short circuit by the adhering ink, and thus the terminal 467 may have a not-intended voltage. In a case where such a not-intended voltage is supplied to the terminal 467, the ejection module 21 in addition to the ejection characteristics of the ink may have a problem.

Thus, the criterion voltage circuit 450 in the embodiment includes the voltage detection unit 455 that stops an operation of the voltage generation unit 451 in a case where the voltage of the criterion voltage signal VBS has risen to be higher than the predetermined value, and performs an instruction to release the charges in the terminal 467.

Figure 21:
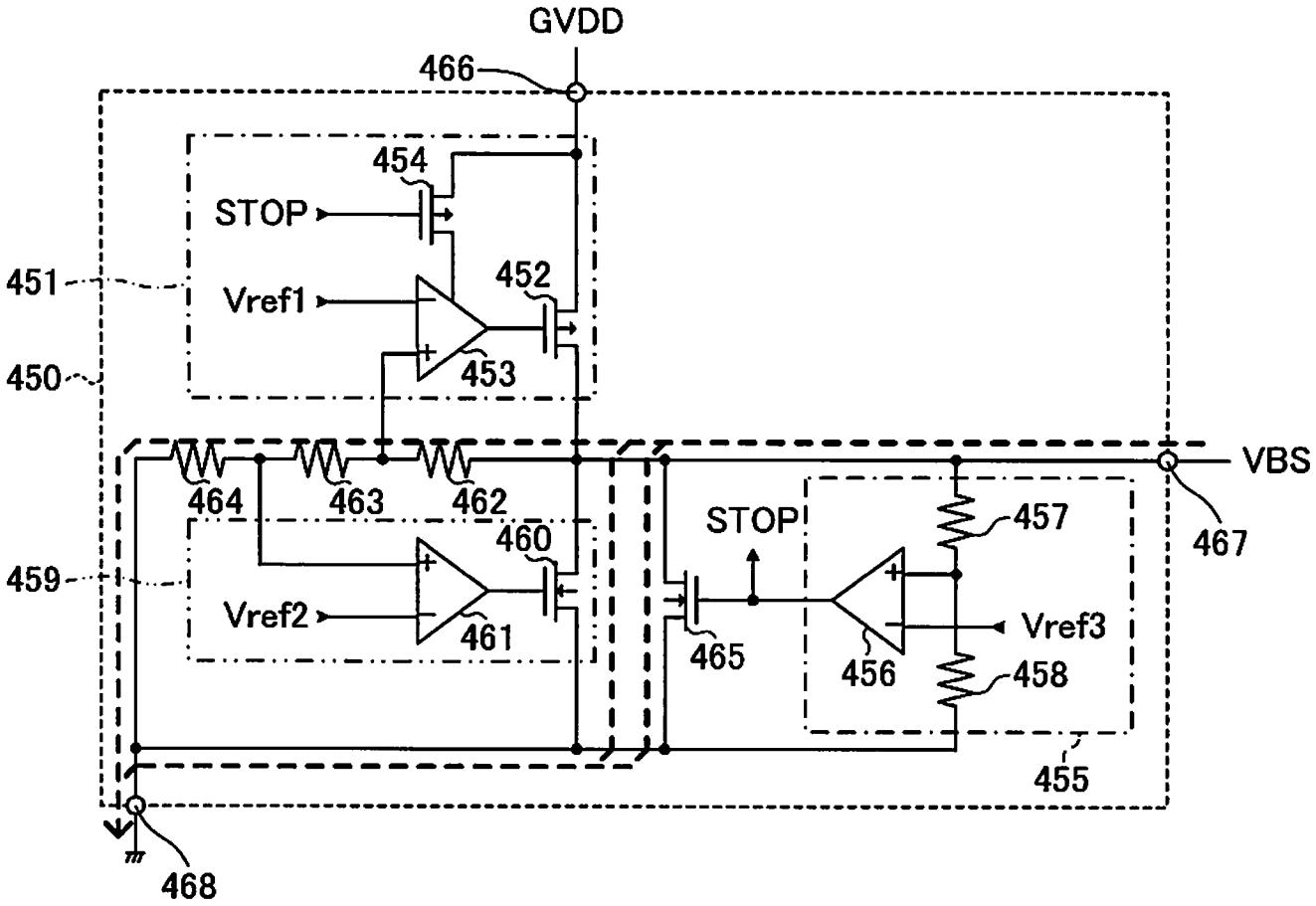
FIG. 21 is a diagram illustrating an operation in a case where charges for the criterion voltage signal are discharged in a case where the voltage of the criterion voltage signal has risen to be equal to or greater than a predetermined value.

FIG. 21 is a diagram illustrating an operation in a case where the charges of the criterion voltage signal VBS are released in a case where the voltage of the criterion voltage signal VBS has risen to be higher than the predetermined value in the criterion voltage circuit 450.

As illustrated in FIG. 21, a voltage obtained by dividing the criterion voltage signal VBS by the resistor 457 and the resistor 458 is supplied to an input end (+) of the comparator 456. The third reference voltage Vref3 is supplied to an input end (−) thereof. Specifically, in a case where the voltage of the criterion voltage signal VBS is higher than a predetermined value by about 3 V, the resistance value of each of the resistors 457 and 458 and the voltage of the third reference voltage Vref3 are determined such that the voltage supplied to the input end (+) of the comparator 456 is equal to the third reference voltage Vref3 supplied to the input end (−). "The case where the voltage of the criterion voltage signal VBS is higher than the predetermined value by about 3 V" is an example. The voltage may be a voltage as high as a problem does not occur in the piezoelectric element 60 and the ejection module 21 in a case where the criterion voltage signal VBS having such a voltage is supplied to the electrode 612.

In a case where the voltage of the criterion voltage signal VBS rises, and the voltage supplied to the input end (+) of the comparator 456 is higher than the third reference voltage Vref3, the comparator 456 outputs the control signal STOP having an H level. The control signal STOP of an H level, which is output by the comparator 456 is an example of "a stop signal".

The control signal STOP output by the comparator 456 is supplied to the gate terminal of the transistor 454 and the gate terminal of the transistor 465.

In a case where the control signal STOP having an H level is supplied to the gate terminal of the transistor 454, the transistor 454 is controlled to be in the OFF state. Thus, a supply of the voltage GVDD to the comparator 453 is stopped. Accordingly, the voltage generation unit 451 stops an operation, and a current is not supplied from the terminal 466 to the terminal 467.

In a case where the control signal STOP having an L level is supplied to the gate terminal of the transistor 454, the transistor 454 is controlled to be in the ON state. Thus, the voltage GVDD is supplied to the comparator 453. That is, the transistor 454 performs switching of whether or not the voltage GVDD is supplied to the voltage generation unit 451 and the comparator 453 and is an example of "a first switching circuit".

In a case where the control signal STOP having an H level is supplied to the gate terminal of the transistor 465, the transistor 465 electrically connects the terminal 467 and the terminal 468 to each other. Thus, as indicated by a broken line in FIG. 21, the charges in the terminal 467 are released on a path via the transistor 465 in addition to the path via the resistors 462, 463, and 464 and the path via the transistor 460.

In a case where the control signal STOP having an L level is supplied to the gate terminal of the transistor 465, the terminal 467 is not electrically connected to the terminal 468. That is, the transistor 465 performs switching of whether or not to electrically connect the terminal 467 and the terminal 468 to each other and is an example of "a second switching circuit".

As described above, the criterion voltage circuit 450 in the embodiment includes the voltage generation unit 451 that generates the criterion voltage signal VBS, the clamp circuit 459 that controls the fluctuation of the criterion voltage signal VBS, and the voltage detection unit 455 that protects the piezoelectric element 60 and the ejection module 21 in a case where a problem occurs in the criterion voltage signal VBS. In other words, the voltage generation unit 451 that generates the criterion voltage signal VBS has a configuration of generating the criterion voltage signal VBS at the terminal 467. The clamp circuit 459 has a configuration for causing the criterion voltage signal VBS generated by the voltage generation unit 451 to be stable. The voltage detection unit 455 has a configuration for releasing charges accumulated in the terminal 467 in a case where a problem occurs in the voltage value of the criterion voltage signal VBS. Therefore, the transistor 460 in the clamp circuit 459 is a transistor operating with power saving. The voltage detection unit 455 is a transistor having large rated capacity capable of rapidly releasing a lot of charges. In other words, the rated capacity of the transistor 465 is larger than that of the transistor 460. Thus, it is possible to improve the accuracy of the criterion voltage signal VBS. In addition, it is possible to reduce a probability of a not-intended voltage being supplied to the piezoelectric element 60 even in a case where the terminal 467 has an abnormal voltage.

Here, the phrase that the rated capacity of the transistor 465 is larger than the rated capacity of the transistor 460 means a case where, regarding a voltage value allowed to be supplied between a drain and a source, the transistor 465 is higher than the transistor 460; a case where, regarding a current allowed to be supplied to the drain, the transistor 465 is larger than the transistor 460; or a case where, regarding a safe operation region, the transistor 465 is wider than the transistor 460. For example, as the transistor 465, a transistor having a W/L ratio larger than that of the transistor 460 is provided.

Here, in the voltage detection unit 455, the voltage of the criterion voltage signal VBS in a case where the voltage which is supplied to the input end (+) of the comparator 456 and has been obtained by division with the resistor 457 and the resistor 458 is equal to the third reference voltage Vref3 supplied to the input end (−) of the comparator 456 is an example of "a first threshold". Specifically, the voltage obtained by increasing the voltage of the criterion voltage signal VBS to be higher than the predetermined value by about 3 V is an example of "the first threshold".

In the clamp circuit 459, the voltage of the criterion voltage signal VBS in a case where the voltage which is supplied to the input end (+) of the comparator 461 and has been obtained by division with the resistor 464 and the combined resistor of the resistor 462 and the resistor 463 is equal to the second reference voltage Vref2 supplied to the input end (−) of the comparator 461 is an example of "a second threshold". Specifically, the voltage obtained by increasing the voltage of the criterion voltage signal VBS to be higher than the predetermined value by about 1 V is an example of "the second threshold".

8. Discharge of Piezoelectric Element when Problem Occurs in Criterion Voltage Signal As described above, in a case where the voltage of the criterion voltage signal VBS rises, and the control signal STOP having an H level is output by the voltage detection unit 455, charges in the terminal 467 from which the criterion voltage signal VBS is output are released. That is, charges in the electrode 612 of the piezoelectric element 60 are released.

In a case where the drive signal VOUT is supplied to the electrode 611, or the voltage is held in the electrode 611, if charges in the electrode 612 of the piezoelectric element 60 are released, the potential difference between the electrode 611 and the electrode 612 may increase, and the piezoelectric element 60 may perform not-intended displacement. In the liquid ejecting apparatus 1 in the embodiment, in order to reduce an occurrence of such not-intended displacement of the piezoelectric element 60, two discharge units that release charges in the electrode 611 based on the control signal STOP are provided.

As illustrated in FIG. 3, the control signal STOP is also supplied to the signal selection circuit 420 of the drive signal generation circuit 50. In a case where the control signal STOP having an H level is supplied, the signal selection circuit 420 holds predetermined data in a predetermined register corresponding to each of the power-supply control signal generation circuit 430 and the LC discharge circuit 530, and outputs the data in a form of the discharge control signals DIS1 and DIS2. Specifically, in a case where the control signal STOP having an H level is supplied, the signal selection circuit 420 holds data having an H level in a predetermined register corresponding to the power-supply control signal generation circuit 430, and outputs the data in a form of the discharge control signal DIS1 having an H level. Similarly, in a case where the control signal STOP having an H level is supplied, the signal selection circuit 420 holds data having an H level in a predetermined register corresponding to the LC discharge circuit 530, and outputs the data in a form of the discharge control signal DIS2 having an H level.

Figure 22:
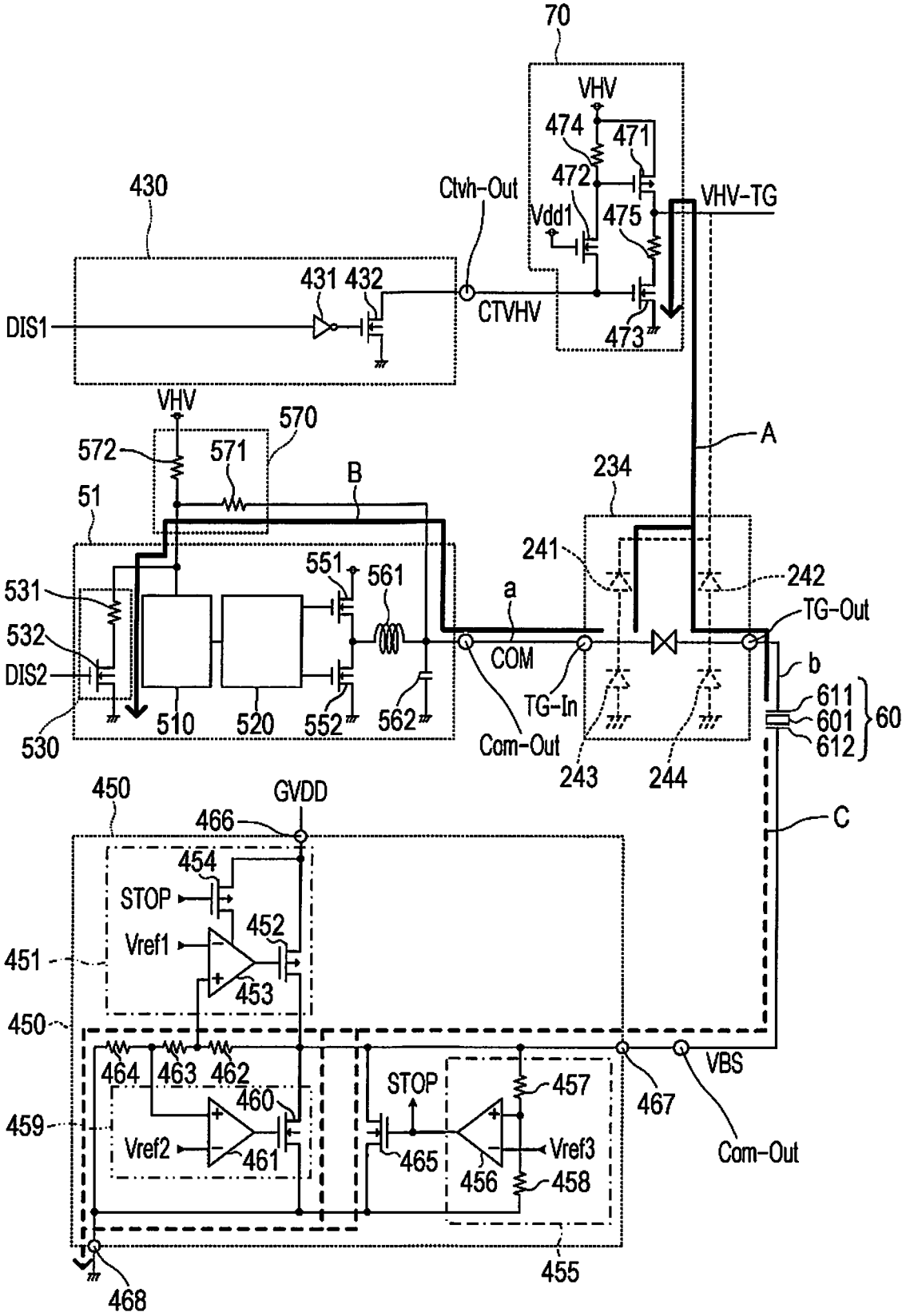
FIG. 22 is a diagram illustrating a discharge unit that releases charges of an electrode in the piezoelectric element.

FIG. 22 is a diagram illustrating the discharge unit for releasing charges in the electrode 611 of the piezoelectric element 60. In FIG. 22, parasitic diodes 241, 242, 243, and 244 formed in the transfer gate 234 are indicated by broken lines. In FIG. 22, a path of releasing the charges in the electrode 612 is indicated as a third discharge path C.

The first discharge unit releases charges via a first discharge path A illustrated in FIG. 22. Specifically, the first discharge unit releases charges accumulated between the terminal TG-Out and the electrode 611 via a plurality of parasitic diodes formed in the transfer gate 234 and releases charges accumulated between the terminal Com-Out and the terminal TG-In.

Here, details of the parasitic diodes 241, 242, 243, and 244 formed in the transfer gate 234 will be described with reference to FIG. 23.

Figure 23:
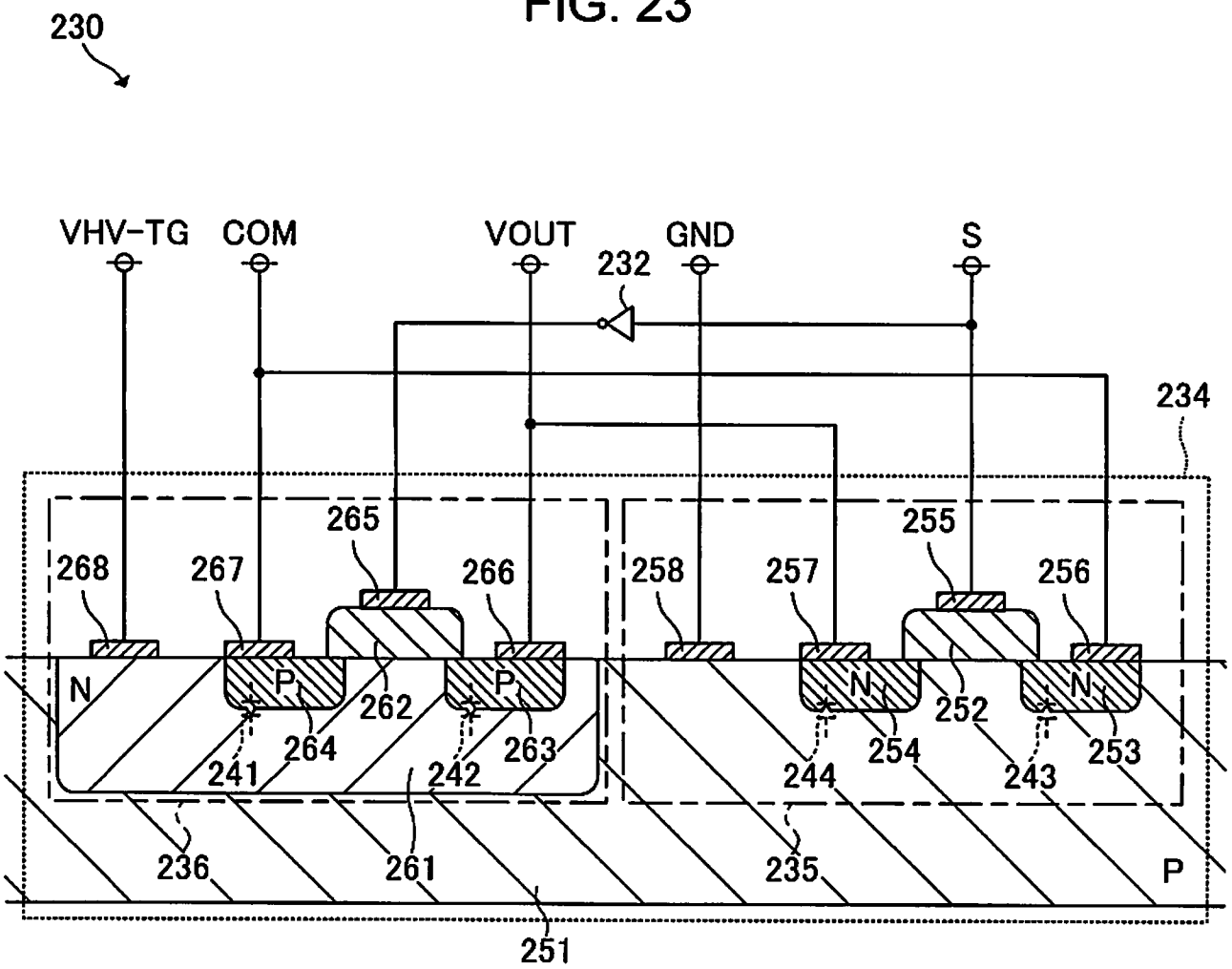
FIG. 23 is a sectional view schematically illustrating a transistor constituting a transfer gate.

FIG. 23 is a sectional view schematically illustrating the transistors 235 and 236 constituting the transfer gate 234.

As illustrated in FIG. 23, the transistor 235 includes a polysilicon 252, N-type diffusion layers 253 and 254, and a plurality of electrodes.

The N-type diffusion layers 253 and 254 are formed on a P-type substrate 251 to be spaced from each other. The polysilicon 252 is formed between the N-type diffusion layer 253 and the N-type diffusion layer 254 with an insulating layer (not illustrated) interposed therebetween.

An electrode 255 is formed on the polysilicon 252. An electrode 256 is formed on the N-type diffusion layer 253. An electrode 257 is formed on the N-type diffusion layer 254.

The electrode 255 functions as a gate terminal. Any one of the electrodes 256 and 257 functions as a drain terminal, and the other functions as a source terminal. In the embodiment, descriptions will be made on the assumption that the electrode 256 is set as the drain terminal, and the electrode 257 is set as the source terminal.

In the transistor 235 constituted in the above-described manner, a PN junction is formed on a contact surface between the P-type substrate 251 and the N-type diffusion layer 253 and a contact surface between the P-type substrate 251 and the N-type diffusion layer 254. Thus, the parasitic diode 243 and the parasitic diode 244 are formed in the transistor 235. In the parasitic diode 243, the P-type substrate 251 functions as an anode, and the N-type diffusion layer 253 functions as a cathode. In the parasitic diode 244, the P-type substrate 251 functions as an anode, and the N-type diffusion layer 254 functions as a cathode.

An electrode 258 is formed on the P-type substrate 251. Since the transistor 235 is formed in the P-type substrate 251, the electrode 258 functions as a back gate terminal of the transistor 235. The ground potential is supplied to the electrode 258.

The transistor 236 includes an N-well 261, a polysilicon 262, P-type diffusion layers 263 and 264, and a plurality of electrodes.

The P-type diffusion layers 263 and 264 are formed on the N-well 261 formed in the P-type substrate 251 to be spaced from each other. The polysilicon 262 is formed between the P-type diffusion layer 263 and the P-type diffusion layer 264 with an insulating layer (not illustrated) interposed therebetween.

An electrode 265 is formed on the polysilicon 262. An electrode 266 is formed on the P-type diffusion layer 263. An electrode 267 is formed on the P-type diffusion layer 264.

The electrode 265 functions as a gate terminal. Any one of the electrodes 266 and 267 functions as a drain terminal, and the other functions as a source terminal. In the embodiment, descriptions will be made on the assumption that the electrode 266 is set as the drain terminal, and the electrode 267 is set as the source terminal.

In the transistor 236 constituted in the above-described manner, a PN junction is formed on a contact surface between the N-well 261 and the P-type diffusion layer 263 and a contact surface between the N-well 261 and the P-type diffusion layer 264. Thus, the parasitic diode 242 and the parasitic diode 241 are formed in the transistor 236. In the parasitic diode 242, the P-type diffusion layer 263 functions as an anode, and the N-well 261 functions as a cathode. In the parasitic diode 241, the P-type diffusion layer 264 functions as an anode, and the N-well 261 functions as a cathode.

An electrode 268 is formed on the N-well 261. Since the transistor 236 is formed in the N-well 261, the electrode 268 functions as a back gate terminal of the transistor 236. The voltage VHV-TG is supplied to the electrode 268.

Returning to FIG. 22, the first discharge unit which includes the parasitic diodes 241, 242, 243, and 244 described above and passes in the first discharge path A will be described.

In the first discharge unit, firstly, the discharge control signal DIS1 having an H level is supplied to the power-supply control signal generation circuit 430.

The discharge control signal DIS1 supplied to the power-supply control signal generation circuit 430 is supplied to the transistor 432 via the inverter 431. Thus, the transistor 432 is controlled to be in the OFF state.

As described above, in a case where the transistor 432 is controlled to be in the OFF state, the transistor 473 of the power supply switching circuit 70 is controlled to be in the ON state. If the transistor 473 is controlled to be in the ONF state, the voltage VHV-TG has a ground potential supplied via the resistor 475. Thus, the electrode 268 of the transistor 236 constituting the transfer gate 234 has a ground potential. Accordingly, the potential at a node a at which the terminal COM-Out and the terminal TG-In are connected to each other becomes the ground potential via the parasitic diode 241. Similarly, the potential at a node b at which the terminal TG-Out and the electrode 611 are connected to each other becomes the ground potential via the parasitic diode 242. The node b is an example of "a first node". The node a is an example of "a second node".

In other words, charges accumulated in the node a are released via the parasitic diode 241, the resistor 475, and the transistor 473. Similarly, charges accumulated in the node b are released via the parasitic diode 242, the resistor 475, and the transistor 473.

As described above, in the first discharge unit, the power supply switching circuit 70 sets the potential of the voltage VHV-TG to be the ground potential based on the discharge control signal DIS1. Thus, the charges accumulated in the node a and the node b are released via the parasitic diodes 241 and 242.

The charges in the node a and the node b, which are released by the first discharge unit correspond to charges at the terminals TG-In and TG-Out of the transfer gate 234. Thus, the charges can be released by the first discharge unit regardless of that the transfer gate 234 is controlled to be in the ON state or the OFF state.

The configuration of the power supply switching circuit 70 is not limited to the above-described configuration. Any configuration may be provided as the configuration of the power supply switching circuit so long as the potential of the electrode 268 in the transistor 236 can be switched to be the ground potential.

Next, the second discharge unit will be described. In the second discharge unit, charges accumulated in the node a are released via a second discharge path B including the LC discharge circuit 530.

In a case where charges are released by the second discharge unit, firstly, the discharge control signal DIS2 having an H level is supplied to the transistor 532 of the LC discharge circuit 530. Thus, the transistor 532 is controlled to be in the ON state. Accordingly, the potential at the node a becomes the ground potential via the resistors 571 and 531 and the transistor 532. In other words, the charges accumulated in the node a are released via the resistors 571 and 531 and the transistor 532.

In a case where an operation of the drive signal generation circuit 50 stops, the voltage VHV may be supplied to the node a via the resistors 572 and 571. In the second discharge unit, the charges in the node a are capable of being released. Thus, it is possible to reduce an occurrence of a situation in which charges are accumulated in the node a by the voltage VHV.

As described above, in the second discharge unit, the charges in the node a are can be released. Thus, it is possible to lower the potential of the node a. Thus, a leakage current occurring from the terminal TG-In of the transfer gate 234 into the terminal TG-Out is reduced. That is, it is possible to reduce an increase of the voltage at the node b, which is caused by the leakage current. Accordingly, it is possible to further reduce a probability of not-intended charges being accumulated in the electrode 611.

The LC discharge circuit 530 may have a configuration in which charges in the node a can be released. For example, the LC discharge circuit 530 may be provided at a connection point which is commonly connected to the source terminal of the transistor 551 and the drain terminal of the transistor 552.

As described above, since the charges for the voltage of the electrode 611 are released by the first discharge unit and the second discharge unit in a case where the voltage of the criterion voltage signal VBS rises, it is possible to release charges in both the electrode 611 and the electrode 612 of the piezoelectric element 60 and to reduce an occurrence of a situation in which the piezoelectric element 60 performs not-intended displacement.

9. Advantageous Effects

In the above-described liquid ejecting apparatus 1 according to the embodiment, in a case where the voltage of the criterion voltage signal VBS supplied to the electrode 612 of the piezoelectric element 60 rises and then is higher than the predetermined threshold, generation of the criterion voltage signal VBS stops, and the terminal from which the criterion voltage signal VBS is connected to the ground terminal. Thus, it is possible to reduce the occurrence of a situation in which the piezoelectric element 60 and the vibration plate 621 perform not-intended displacement by the voltage of the criterion voltage signal VBS rising.

In the liquid ejecting apparatus 1 according to the embodiment, the voltage detection unit 455 in the criterion voltage circuit 450 that generates the criterion voltage signal VBS detects whether or not the voltage of the criterion voltage signal VBS rises and then is higher than the predetermined threshold. Therefore, it is possible to reduce a delay until generation of the criterion voltage signal VBS is stopped, in a case where the voltage of the criterion voltage signal VBS has risen. Thus, it is possible to further reduce the occurrence of a situation in which the piezoelectric element 60 and the vibration plate 621 perform not-intended displacement by the voltage of the criterion voltage signal VBS rising.

In the liquid ejecting apparatus 1 according to the embodiment, in a case where the voltage of the criterion voltage signal VBS rises and then is higher than the predetermined threshold, the voltage detection unit 455 outputs the control signal STOP having an H level. The generation of the criterion voltage signal VBS in the voltage generation unit 451 is stopped based on the control signal STOP having an H level, and the charges in the electrode 611 are released. Thus, the voltage between the electrodes 611 and 612 is slowly lowered toward the ground potential. Accordingly, the potential difference between the electrodes 611 and 612 is reduced, and the occurrence of a situation in which the piezoelectric element 60 performs not-intended displacement is reduced.

In the liquid ejecting apparatus 1 according to the embodiment, the criterion voltage circuit 450 includes the clamp circuit 459 that reduce voltage fluctuation of the criterion voltage signal VBS. Thus, the clamp circuit 459 can reduce the voltage fluctuation of the criterion voltage signal VBS, and thus an occurrence of a situation in which the voltage is supplied to the electrode 612 of the piezoelectric element 60 without an intention is reduced. Accordingly, it is possible to further reduce the occurrence of a situation in which the piezoelectric element 60 and the vibration plate 621 perform not-intended displacement by the voltage of the criterion voltage signal VBS fluctuating.

As described above, in the liquid ejecting apparatus 1 in the embodiment, it is possible to reduce the concern that the piezoelectric element 60 and the vibration plate 621 perform not-intended displacement. Thus, it is possible to reduce a concern that cracks occur in the vibration plate 621 by stress concentrating.

10. Modification Examples

In the above embodiment, the descriptions in which, in a case where the voltage detection unit 455 outputs the control signal STOP having an H level, the operation of the voltage generation unit 451 is stopped, the transistor 465 electrically connects the terminal 467 and the terminal 468, and the charges in the electrode 611 are released are made. However, at least any one of a control of electrically connecting the terminal 467 and the terminal 468 by the transistor 465 and a control of releasing the charges in the electrode 611 may be performed. Even in this case, it is possible to obtain the similar effects.

In the above embodiment, a serial scan type (serial print type) ink jet printer in which the head unit 20 moves, and printing is performed on a medium P is exemplified as the liquid ejecting apparatus. However, the invention can be applied to a line head type ink jet printer that performs printing on a print medium without moving a head.

The invention includes substantially the same configuration as the configuration described in the embodiment (for example, a configuration having the same function, method, and result, or a configuration having the same object and effect). The invention includes a configuration in which non-essential parts of the configuration described in the embodiment are replaced. The invention includes a configuration that can achieve a configuration for obtaining the same advantageous effect or the same object as the configuration described in the embodiment. The invention includes a configuration in which a well-known technique is added to the configuration described in the embodiment.

What is claimed is:

1. A liquid ejecting apparatus comprising:
- a drive circuit that outputs a drive signal from a drive-signal output terminal;
- a criterion voltage circuit that outputs a criterion voltage signal from a criterion voltage-signal output terminal;
- a piezoelectric element that includes a first electrode to which the drive signal is supplied and a second electrode to which the criterion voltage signal is supplied, and that performs displacement by a potential difference between the first electrode and the second electrode;
- a cavity which is filled with a liquid being ejected from a nozzle by the displacement of the piezoelectric element; and
- a vibration plate which is provided between the cavity and the piezoelectric element,
- wherein the criterion voltage circuit includes
  - a voltage generation unit that generates the criterion voltage signal, and
  - a voltage detection unit that detects a voltage value of the criterion voltage signal, and
- in a case where the voltage value of the criterion voltage signal is greater than a first threshold, the voltage detection unit stops an operation of the voltage generation unit and electrically connects the criterion voltage-signal output terminal and a ground terminal to each other.

2. The liquid ejecting apparatus according to claim 1,
- wherein the criterion voltage circuit includes
  - a first switching circuit that performs switching of whether or not a power-supply voltage is supplied to the voltage generation unit, and
  - a second switching circuit that performs switching of whether or not the criterion voltage-signal output terminal and the ground terminal are electrically connected to each other,
- the voltage detection unit outputs a stop signal in a case where the voltage value of the criterion voltage signal is greater than the first threshold,
- the first switching circuit stops a supply of the power-supply voltage to the voltage generation unit, based on the stop signal, and
- the second switching circuit electrically connects the criterion voltage-signal output terminal and the ground terminal to each other, based on the stop signal.

3. The liquid ejecting apparatus according to claim 2,
- wherein the voltage generation unit includes
  - a first comparator that compares a first reference voltage and a signal based on the criterion voltage signal to each other, and
  - a first transistor that performs switching of whether or not the power supply terminal and the criterion voltage-signal output terminal are electrically connected to each other, based on a comparison result of the first comparator, and
- in a case where the voltage value of the criterion voltage signal is greater than the first threshold, the first switching circuit stops a supply of the power-supply voltage to the first comparator, based on the stop signal.

4. The liquid ejecting apparatus according to claim 1,
- wherein the criterion voltage circuit includes a clamp circuit, and
- in a case where the voltage value of the criterion voltage signal is greater than a second threshold lower than the first threshold, the clamp circuit electrically connects the criterion voltage-signal output terminal and the ground terminal to each other.

5. The liquid ejecting apparatus according to claim 4,
- wherein the clamp circuit includes
  - a second comparator that compares a second reference voltage and a signal based on the criterion voltage signal to each other, and
  - a second transistor that performs switching of whether or not the criterion voltage-signal output terminal and the ground terminal are electrically connected to each other, based on a comparison result of the second comparator, and in a case where the voltage value of the criterion voltage signal is greater than the second threshold, the second transistor electrically connects the criterion voltage-signal output terminal and the ground terminal to each other.

6. A liquid ejecting apparatus comprising:

a drive circuit that outputs a drive signal from a drive-signal output terminal;

a criterion voltage circuit that outputs a criterion voltage signal from a criterion voltage-signal output terminal;

a piezoelectric element that includes a first electrode to which the drive signal is supplied and a second electrode to which the criterion voltage signal is supplied, and that performs displacement by a potential difference between the first electrode and the second electrode;

a cavity which is filled with a liquid being ejected from a nozzle by the displacement of the piezoelectric element;

a vibration plate which is provided between the cavity and the piezoelectric element; and a switching circuit that includes a first terminal to which the drive signal is supplied and a second terminal which is electrically connected to the first electrode, and that controls a supply of the drive signal to the first electrode, wherein the criterion voltage circuit includes a voltage generation unit that generates the criterion voltage signal, and a voltage detection unit that detects a voltage value of the criterion voltage signal, and in a case where the voltage value of the criterion voltage signal is greater than a first threshold, the voltage detection unit stops an operation of the voltage generation unit and releases charges at a first node via a parasitic diode of the switching circuit, the first electrode and the second terminal being electrically connected at the first node.

7. The liquid ejecting apparatus according to claim 6, wherein, in a case where the voltage value of the criterion voltage signal is greater than the first threshold, charges at a second node at which the drive-signal output terminal and the first terminal are electrically connected are discharged.

8. A liquid ejecting apparatus comprising:

a drive circuit that outputs a drive signal from a drive-signal output terminal;

a criterion voltage circuit that outputs a criterion voltage signal from a criterion voltage-signal output terminal;

a piezoelectric element that includes a first electrode to which the drive signal is supplied and a second electrode to which the criterion voltage signal is supplied, and that performs displacement by a potential difference between the first electrode and the second electrode;

a cavity which is filled with a liquid being ejected from a nozzle by the displacement of the piezoelectric element; and a vibration plate which is provided between the cavity and the piezoelectric element, wherein the criterion voltage circuit includes a first discharge transistor and a second discharge transistor having rated capacity larger than that of the first discharge transistor, one end of the first discharge transistor and one end of the second discharge transistor are electrically connected to the criterion voltage-signal output terminal, and another end of the first discharge transistor and another end of the second discharge transistor are electrically connected to a ground terminal.

* * * * *